US011191350B2

(12) United States Patent
Bugg

(10) Patent No.: US 11,191,350 B2
(45) Date of Patent: Dec. 7, 2021

(54) CANTILEVER TABLE FOR MOUNTING TO VEHICLE CARGO AREA

(71) Applicant: Space Innovation Labs LLC, Denver, CO (US)

(72) Inventor: Lawrence Bugg, Wesley Chapel, FL (US)

(73) Assignee: SPACE INNOVATION LABS LLC, Denver, CO (US)

( * ) Notice: Subject to any disclaimer, the term of this patent is extended or adjusted under 35 U.S.C. 154(b) by 0 days.

(21) Appl. No.: 17/334,694

(22) Filed: May 29, 2021

(65) Prior Publication Data

US 2021/0282545 A1 Sep. 16, 2021

Related U.S. Application Data

(60) Provisional application No. 63/117,485, filed on Nov. 24, 2020.

(51) Int. Cl.

| | |
|---|---|
| ***A47B 1/10*** | (2006.01) |
| ***A47B 3/08*** | (2006.01) |
| ***A47B 13/08*** | (2006.01) |
| ***A47B 13/10*** | (2006.01) |
| ***A47B 13/16*** | (2006.01) |

(52) U.S. Cl.

CPC ..... *A47B 1/10* (2013.01); *A47B 3/08* (2013.01); *A47B 13/081* (2013.01); *A47B 13/10* (2013.01); *A47B 13/16* (2013.01); *A47B 2003/0824* (2013.01)

(58) Field of Classification Search

CPC ..... A47B 31/06; A47B 5/00

USPC ..... 108/44, 152

See application file for complete search history.

(56) References Cited

U.S. PATENT DOCUMENTS

| | | | | |
|---|---|---|---|---|
| 1,317,895 A | | 10/1919 | Rudy | |
| 2,394,447 A | * | 2/1946 | Hemp | B60R 9/06 224/516 |
| 2,471,730 A | * | 5/1949 | Doerr | B60N 3/001 108/33 |
| 2,718,445 A | * | 9/1955 | Wilson | A47B 5/00 108/44 |
| 2,721,777 A | * | 10/1955 | Willis | B60N 3/001 108/44 |

(Continued)

FOREIGN PATENT DOCUMENTS

DE 202009007562 U1 10/2009

*Primary Examiner* — Jose V Chen

(74) *Attorney, Agent, or Firm* — Resolute Legal PLLC

(57) ABSTRACT

A cantilever table is configured to attach to a vehicle cargo area. The cantilever table includes a first portion slidably engaged with a second portion in a manner that allows the first portion to be stored beneath the second portion when the table is not in use. The first portion includes a handle at the proximal end, a hook fastener configured to engage a closure latch in the vehicle cargo area, a first adjustable support configured to extend vertically downward from the lower surface, and a second adjustable support comprising a pair of independently adjustable supports configured to extend downwardly at an angle toward a bumper in the vehicle cargo area. Generally, cantilever tables provide a compact storage configuration for transportation in a vehicle. Inventive tables can be easily assembled and supported solely from the vehicle during use.

25 Claims, 15 Drawing Sheets

(56) References Cited

U.S. PATENT DOCUMENTS 2,755,152 A * 7/1956 Calgy ..... A61G 13/105 108/1
2,833,608 A * 5/1958 Tobias ..... B60N 3/001 108/44
3,709,159 A * 1/1973 Oglesby, Jr. ..... A47B 3/0912 108/44
3,899,982 A * 8/1975 Fetzek ..... B60N 3/102 108/25
4,452,151 A * 6/1984 Jarrard ..... B60R 5/04 108/42
4,494,465 A * 1/1985 Fick, Jr. ..... A47B 3/083 108/131
D286,344 S 10/1986 Hughes, Jr.
4,830,243 A * 5/1989 Mann ..... A61H 3/00 108/44
4,834,273 A 5/1989 Cimino
4,858,796 A * 8/1989 Roth ..... B60N 3/002 224/482
4,887,526 A * 12/1989 Blatt ..... B60N 3/001 108/44
5,005,491 A 4/1991 Waterman
5,090,335 A 2/1992 Russell
5,136,953 A * 8/1992 Schmidt ..... B60N 3/001 108/44
5,239,934 A * 8/1993 Miller ..... B25H 1/12 108/44
D343,601 S * 1/1994 Brady ..... D12/425
5,479,866 A * 1/1996 Rae ..... A47B 23/001 108/25
5,540,158 A * 7/1996 Ford ..... A47B 3/08 108/115
5,685,468 A * 11/1997 Hernandez ..... B60R 11/06 108/44
5,720,522 A * 2/1998 Habeck ..... A47C 9/06 108/27
5,730,066 A * 3/1998 Auten ..... B60N 3/001 108/44
5,857,741 A 1/1999 Anderson
5,947,032 A * 9/1999 Meier ..... A47B 5/06 108/33
5,996,666 A * 12/1999 Denina ..... E04F 10/10 160/202
6,095,059 A * 8/2000 Riley ..... B60N 2/00 108/152
6,113,171 A 9/2000 Stearns
6,142,140 A * 11/2000 Shumaker ..... A47B 96/027 108/152
6,250,702 B1 6/2001 Eipper
6,314,891 B1 11/2001 Larson
6,336,413 B1 1/2002 Ball
6,467,417 B1 10/2002 Guyot et al.
D466,469 S 12/2002 Nelson, Jr.
6,705,235 B1 * 3/2004 Gerutto ..... A47B 5/00 108/152
6,739,269 B1 5/2004 Benton
6,910,429 B1 * 6/2005 Matay ..... B25H 3/06 108/152
7,090,104 B2 8/2006 Dorety
7,309,202 B1 12/2007 Anderson
D563,126 S * 3/2008 Morris ..... D6/707.19
D618,012 S 6/2010 Erne et al.
D638,945 S 5/2011 Velasquez et al.
7,966,950 B2 * 6/2011 Volpe, Jr. ..... B60N 3/002 108/44
8,166,695 B2 5/2012 Pippin
8,256,818 B1 9/2012 Tovani
9,770,097 B2 * 9/2017 Ehrreich ..... A47B 3/0912
D808,695 S 1/2018 MacAllen et al.
10,030,447 B2 * 7/2018 Pyros ..... E04G 1/18
10,035,465 B2 7/2018 Waddell
10,160,364 B2 * 12/2018 Howe ..... A47B 37/04
D865,419 S 11/2019 Chavarria
10,532,683 B1 * 1/2020 Bowman ..... B60P 1/003
10,661,842 B2 5/2020 Povinelli et al.
D892,221 S 8/2020 Farley
10,793,043 B2 10/2020 Tovani
2005/0092213 A1 5/2005 Wilson et al.
2006/0016372 A1 * 1/2006 Younse ..... A47B 21/0314 108/44
2009/0179447 A1 7/2009 Woodhouse et al.

* cited by examiner

CANTILEVER TABLE FOR MOUNTING TO VEHICLE CARGO AREA

CROSS-REFERENCE TO RELATED APPLICATIONS

This application claims benefit under 35 U.S.C. 119(e) to U.S. Provisional Patent Application Ser. No. 63/117,485 entitled, "Cantilever Table for Mounting to Vehicle Cargo Area" and filed on 24 Nov. 2020, the contents of which are incorporated herein in their entirety for all purposes.

FIELD

Inventive concepts provide portable tables for mounting to a vehicle cargo area. More specifically, inventive concepts provide cantilever tables that mount to a closure latch within the vehicle cargo area.

BACKGROUND

Social gatherings hosted on and around the open tailgate of a vehicle are an enduring American pastime. Tailgate parties can occur in the parking lots of stadiums and arenas, before and after games and concerts. These social gatherings also include non-sporting events such as weddings, barbecues, and camping. Providing food and beverages from the tailgate of a vehicle can also be useful when taking a break during a road trip or simply enjoying the outdoors with an impromptu picnic.

Various vehicle-mounted expandable table systems have been developed for these activities. However, such table systems can occupy relatively valuable and/or large amounts of cargo space in vehicles. Further, the movable nature of such table systems, which facilitates their expandability, also permits significant movement and vibration during transit. Many table systems are stand-alone structures that are completely removed from the vehicle, while other tables utilize the vehicle trailer hitch, contain multiple components that must be assembled on-site, and/or contain supports that contact the ground for stability.

SUMMARY

Inventive concepts described herein relate to cantilever tables for mounting to a vehicle cargo area. Generally speaking, inventive tables provide a unitary device that is simple to install, remove, and store. In some implementations, cantilever tables are composed of two portions that are slidably engaged, so that a first portion can be stored beneath a second portion when the table is not in use. In this way, the profile of the device is compact, and it can be easily stored in the trunk or cargo area of a vehicle.

In accordance with inventive principles, tables are constructed using a cantilever system. The table is removably attached to a vehicle via a closure latch located within the vehicle cargo area (such as a trunk). The free end of the table projects distally from the vehicle. Support elements of the table contact the vehicle within the cargo area only. Support elements of the table are independently adjustable, so that the horizontal plane of the table can be finely tuned to provide a relatively level surface to accommodate food, beverages, utensils, and food and/or drink vessels.

In some implementations, inventive concepts provide a cantilever table for mounting to a vehicle cargo area, the table comprising:

(a) a first portion having an upper surface, a lower surface, and a proximal end, the first portion comprising
- a handle at the proximal end,
- a hook fastener configured to engage a closure latch in the vehicle cargo area,
- a first adjustable support configured to extend vertically downward from the lower surface, and
- a second adjustable support comprising a pair of independently adjustable supports configured to extend downwardly at an angle toward a bumper in the vehicle cargo area; and (b) a second portion having an upper surface and a lower surface, wherein the first portion is slidably engaged with the second portion in a manner that allows the first portion to be stored beneath the lower surface of the second portion when the table is not in use.

Optional features include one or more of the following. The first portion can contain a removable cutting board. The first portion can comprise two sections that fit together to form the upper surface, such as a cutting board. The upper surface of the first portion, second portion, or both the first portion and the second portion can comprise a non-slip material and/or a food-safe surface. The non-slip material can be provided by an exterior skin (such as a silicone skin), or the table surface can be provided with a textured finish. The upper surface of the second portion can comprise one or more recesses sized to hold food or drink vessels. The second portion can include peripheral slots configured to receive beverage glasses having a stem and/or a beveled periphery. The first portion can be detachable from the second portion. The first adjustable support can comprise a first pair of independently adjustable supports configured to extend vertically downward from the lower surface. The first adjustable support can be threaded.

In some aspects, the lower surface of the first portion includes a longitudinal channel, and the hook fastener is located within the longitudinal channel. In these aspects, the hook fastener is movable from a storage position within the cantilever table to a use position that extends outside the longitudinal channel. In accordance with inventive concepts, the hook fastener is freely movable along the longitudinal channel and rotatable within the longitudinal channel. This free movement within the longitudinal channel allows the hook fastener to be positioned to engage a closure latch in a vehicle, thereby anchoring the cantilever table. In some implementations, the upper surface and the lower surface of the first portion define an interior area, and the hook fastener can be accessible through the interior area. In some aspects, removable components of the cantilever table can be stored in the interior area.

Optionally, the hook fastener can be magnetized and/or can include an adjustment knob. The hook fastener can comprise a J-hook, a cup hook, or a hook of similar design that is configured to attach to a closure latch of a vehicle.

Inventive cantilever tables can be used in connection with a wide variety of vehicles, including cars, SUVs, ATVs, vans, and wagons. When the vehicle comprises a car with a trunk, the closure latch in the vehicle cargo area comprises a trunk latch. Alternatively, when the vehicle comprises a wagon, SUV or van, the closure latch can comprise the hatchback, boot lid or rear door latch, respectively.

In some implementations, the first adjustable support is positioned at the proximal end of the first portion. The second pair of adjustable supports can comprise telescoping legs or a sleeve containing a threaded support member. Optionally, the cantilever table can further comprise a third adjustable support comprising a pair of threaded, independently adjustable supports configured to extend vertically downward from the lower surface. Any of the adjustable supports described herein can be provided with a protective surface or coating at the region where the support contacts the vehicle, to eliminate or reduce the risk of damage to the vehicle. Optionally, any of the adjustable supports can comprise a suitable support mechanism that provides an adjustment feature, such as nested supports, U-shaped supports, a threaded shaft, and the like. The particular number and configuration of adjustable supports can be selected depending upon such features as the particular vehicle, dimensions of the cantilever table, desired table size (number of people to be served and/or intended use of the table), and the like.

Inventive cantilever tables can be fabricated from a suitably durable material, such as hard plastic. For additional strength, the first portion can comprise internal reinforcement elements. In some embodiments, internal reinforcement elements can be fabricated of a metal, such as steel. Optionally, cantilever tables can include a honeycomb framework that can be visible from the exterior of the device. In some aspects, ribbing can be included in various portions of the cantilever table to reduce the overall weight of the cantilever table yet provide a durable product.

In order to reduce the risk of spilling food or drink served on the upper surface of the cantilever table, the upper surface can comprise a non-slip material or textured surface on the first portion, the second portion, or both the first and second portion. Optionally, the upper surface of the second portion can include one or more recesses sized to hold food or drink vessels. The second portion can include peripheral slots configured to receive beverage glasses having a stem.

In some implementations, the second portion can include a beveled periphery. Optionally, the first portion is detachable from the second portion. In some aspects, the table does not include a ground-contacting component.

Inventive concepts include an assembly comprising the cantilever table and a storage container configured to house the cantilever table when not in use. The cantilever table can be one as described above. Optionally, the storage container comprises fasteners to removably attach the storage container to a vehicle.

BRIEF DESCRIPTION OF THE FIGURES

The disclosure may be more completely understood in consideration of the accompanying drawings, in which.

The figures are not necessarily to sale. Like numbers in the figures refer to like components. However, it will be understood that the use of a number to refer to a component in a given figure is not intended to limit the component in another figure labeled with the same number.

DETAILED DESCRIPTION

Figure 1:
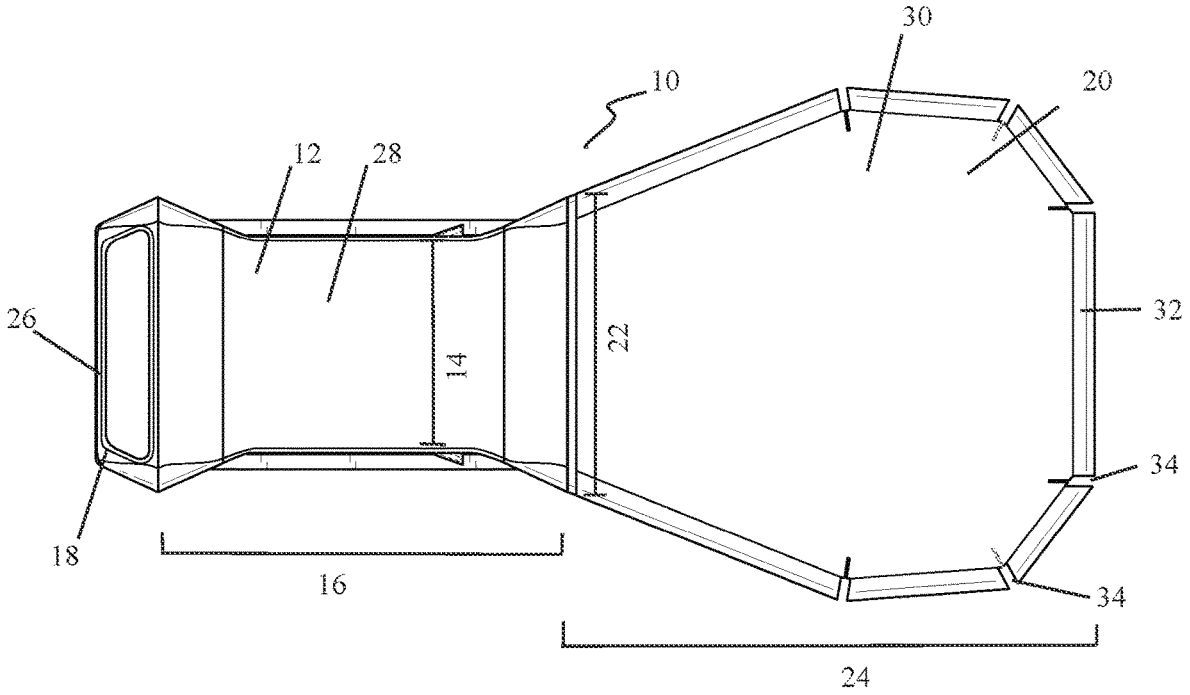
FIG. 1 is a perspective view showing the upper surface of a cantilever table in an expanded, use configuration, in accordance with inventive principles.

In the following description, reference is made to the accompanying set of drawings that form a part hereof and in which are shown by way of illustration several specific embodiments. It is to be understood that other embodiments are contemplated and may be made without departing from the scope or spirit of the present disclosure. The following detailed description, therefore, is not to be taken in a limiting sense.

In this description, the directional prepositions of up, upwardly, down, downwardly, front, back, top, upper, bottom, lower, left, right and other such terms refer to the table as it is oriented and appears in the drawings and are used for convenience only; they are not intended to be limiting or to imply that the table has to be used or positioned in any particular orientation. The term proximal refers to the element or part of the element closest to the front of the vehicle and the term distal refers to the element or part of the element closest to the rear of the vehicle.

Unless otherwise indicated, all numbers herein used to express dimensions, quantities, and the like, should be understood as being modified in all instances by the term "about." In this application, the use of the singular includes the plural unless specifically stated otherwise, and the use of the terms "and" and "or" means "and/or" unless otherwise indicated. Moreover, the use of the term "including," "includes" and "included" should be considered non-exclusive.

Generally, when referring to apparatus herein, reference will be made to cantilever tables configured to be mounted to car trunk areas. Car trunk area applications of the cantilever table will be utilized to describe inventive concepts, as these applications are useful to highlight features and advantages. However, it will be understood upon review of the present specification that inventive cantilever tables can be adapted for additional uses, such as SUVs, ATVs, wagons, trucks, vans, and the like. Inventive concepts can be applied for compatibility with a wide variety of vehicles having similar connectable members included within the vehicle's trunk or cargo area (for example, anchor latches, cargo latches, and the like). Thus, while inventive concepts are described with reference to a closure latch, it will be appreciated that similar latches within the vehicle can perform similar function, and the invention is not limited to use in connection with closure latches.

In some aspects, inventive concepts provide unique tables that can serve as a social gathering area for car owners. The tables are compact and durable, and are designed to provide a stable, level surface to accommodate a wide variety of objects, such as food, beverages, utensils, and food or drink vessels. In some implementations, inventive cantilever tables are sturdy enough to support camping, work-related, or entertainment items, such as lights, portable speakers, small televisions, computers or tablets, and the like. Inventive tables provide opportunities for impromptu picnics or socializing, a place to eat a meal while travelling, a place for tailgating with family and friends, and/or a mobile office that can be located anywhere. Cantilever tables can allow a car owner to avoid eating inside the car when travelling. By providing a table that is easily installed and removed without requiring additional tools, inventive concepts provide a universal item that can be easily transported, shared with others, and used in connection with a wide variety of vehicles. When not in use, the table is easily converted to a storage configuration that fits inside a vehicle storage area, such as a trunk or cargo area of an SUV, wagon, van, or car.

Similarly, portions of inventive cantilever tables can serve a variety of functions, such as a workspace, an entertainment space, a food or beverage preparation space, and/or a space for consuming food. For example, a portion of the cantilever table can serve as a cutting board, and in some aspects, the first portion of the table comprises a cutting board.

As discussed herein, inventive concepts provide unique cantilever tables that are robust and easy to use. At the same time, inventive cantilever tables are provided with a compact storage format that can be easy stored in a car trunk or other vehicle cargo area. Inventive tables are provided as cantilevers, in that they are rigid structural elements that extend horizontally and are supported at only one end. The support end is positioned in the cargo area of a vehicle, such as a car, SUV or van. Inventive cantilever tables extend from a flat portion of the cargo area and are attached via a hook fastener to the closure latch within the vehicle. Thus, in some aspects, inventive tables do not include any components that contact the ground; all support components of the cantilever table contact the vehicle only. Inventive cantilever tables comprise rigid structural elements that are supported at one end (namely, the vehicle-contacting end), and extend horizontally from the vehicle. The proximal (vehicle-contacting) end of the table provides support for the table, while the distal end of the table extends horizontally from the vehicle and is free-standing. In some implementations, inventive cantilever tables include a first portion that is slidably engaged with a second portion, wherein all support elements of the table are included in the first portion, and the second portion of the table is supported solely by the support elements contained in the first portion.

Inventive cantilever tables can be utilized in connection with a wide variety of vehicles, including cars, trucks, SUVs, ATVs, vans, and wagons. Given the universal configuration of the table elements, inventive concepts can be used to provide tables that suit a wide variety of makes, models and configurations. In some aspects, cantilever tables attach to a vehicle at a location within the vehicle itself. In some aspects, attachment is through the closure latch in the vehicle cargo area. In this manner, the table extends from an anchor or attachment point within the vehicle, to a location outside the vehicle, providing a table that can be used to support desired objects such as food, beverages, utensils, and the like.

As used herein, the vehicle cargo area includes the rear storage area of a vehicle, including the rear door or trunk seal area and bumper. For cars, the vehicle cargo area includes the interior trunk of the car, as well as the trunk seal area and bumper. For SUVs, hatchbacks, and vans, the vehicle cargo area includes the rear storage area of the vehicle, the rear door (e.g., tailgate, boot lid) seal area, and bumper.

In some aspects, inventive cantilever tables can be fabricated of a suitable durable, lightweight material, such as a hard plastic. Optionally, internal reinforcement can be provided within the cantilever table, for example, steel bars or a molded, honeycomb framework.

Figure 16:
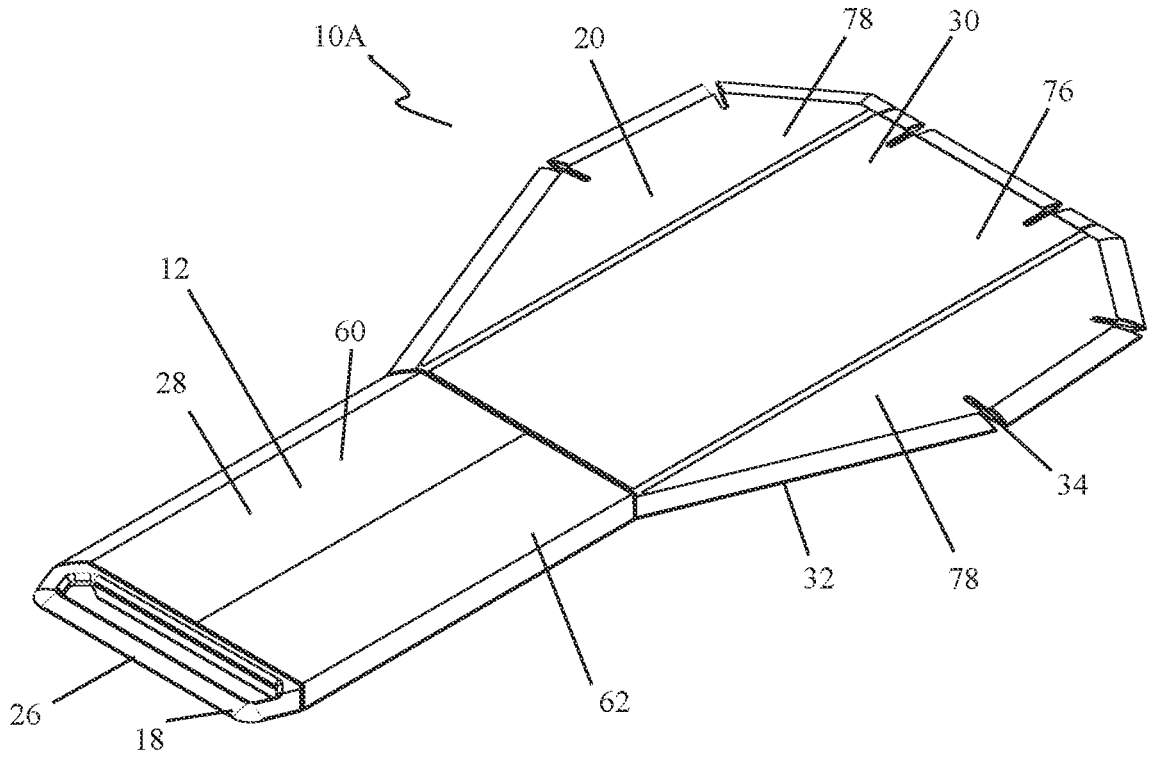
FIG. 16 is a perspective view showing the upper surface of a cantilever table in an expanded, use configuration, in accordance with inventive principles.
Figure 27:
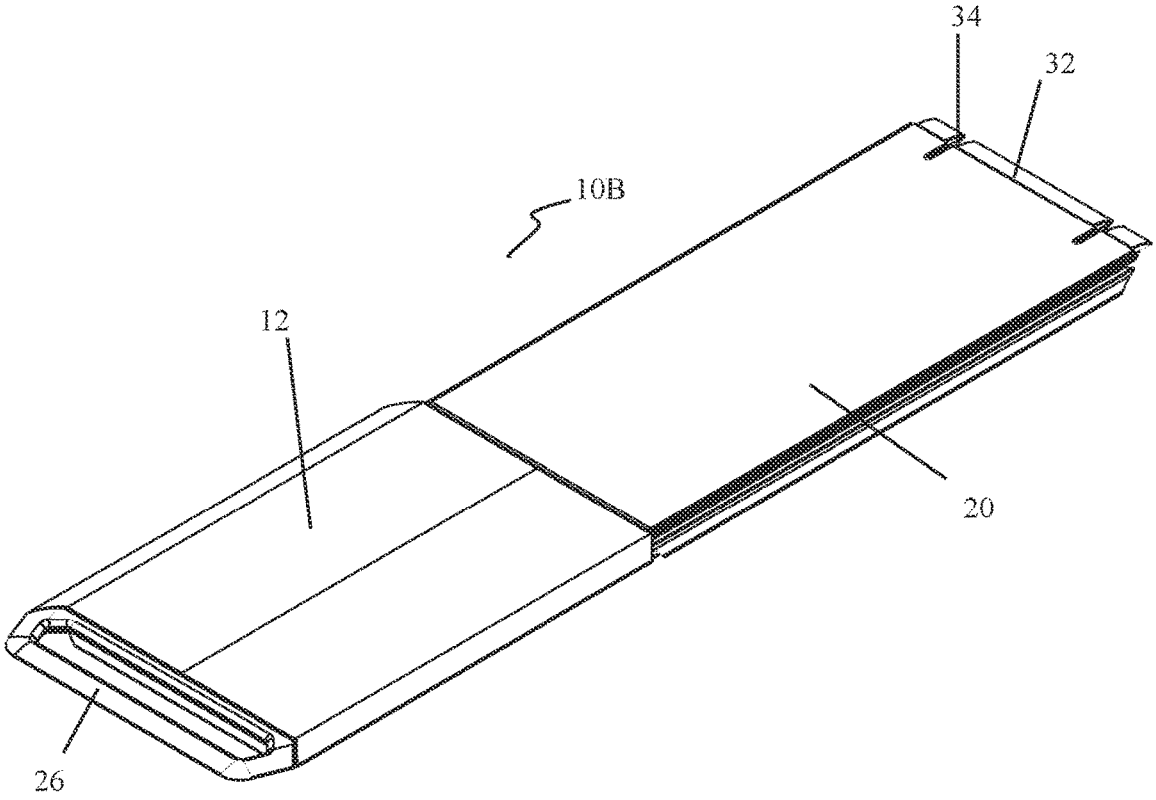
FIG. 27 is a perspective view of a cantilever table in accordance with inventive principles.
Figure 28:
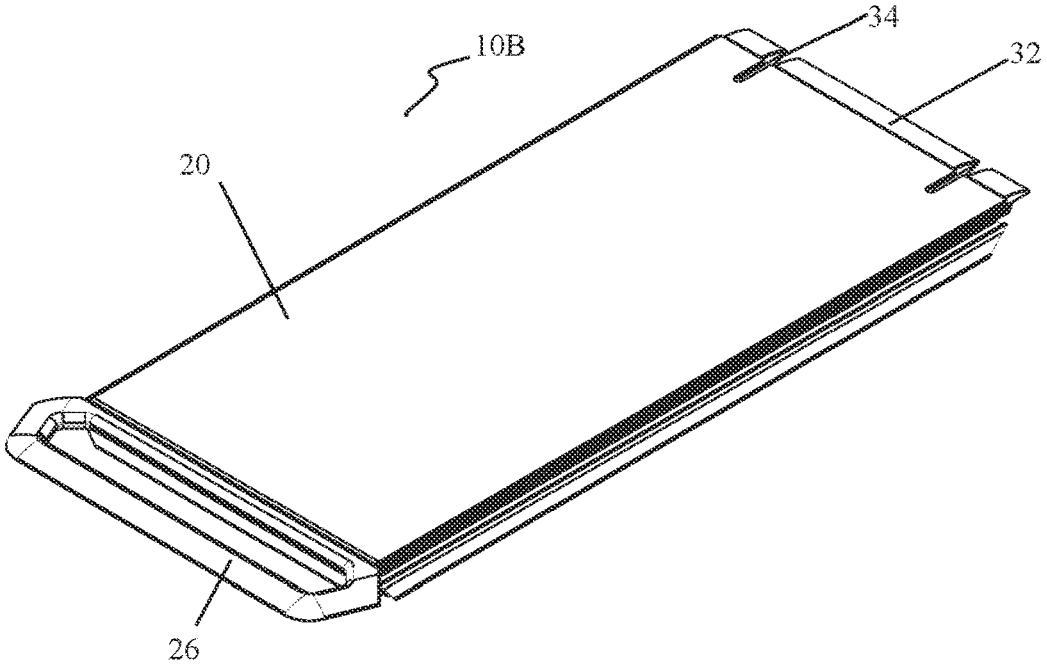
FIG. 28 is a perspective view showing the top surface of the cantilever table shown in FIG. 27 in a collapsed, storage configuration.

Generally speaking, inventive cantilever tables can be provided in at least three basic sizes, namely, a full-sized table 10 and 10A (e.g., as illustrated in FIGS. 1 and 16), extended table 10B (e.g., as illustrated in FIG. 27), and a compact, or personal sized table 10B (e.g., as illustrated in FIG. 28). In embodiments comprising a full-sized table, for example, the fully extended table can be about 48 inches in total length, 30 inches wide, and 3 inches high, and the storage (collapsed) configuration can be roughly half the length and width, such as 24 inches long and 15 inches wide. Thus, some implementations provide a cantilever table that can provide a compact storage size that is 50% of the fully extended (use) size. In addition, removable wings can be used in connection with these basic sizes to increase the variety and shape of the overall cantilever table. FIG. 16 illustrates a cantilever table that includes two such removable wings. Inventive cantilever tables can have a compact storage size as well, the storage size being smaller relative to the usage size. In some aspects, the storage format of the cantilever tables can include components that pivot or screw into the table (so that no parts extend from the body of the table), removable parts (such as wings), and components that are stored within the interior of the cantilever table. Variations on the particular dimensions and shape of cantilever tables can be provided based on the general principles discussed herein.

In some implementations, inventive concepts include a storage container, such as a bag or flexible receptacle. The storage container can include a main compartment for housing the main body of the cantilever table, and smaller compartments for accessories or removable parts. Such compartments may be sized to provide a snug fitting around the component(s) to be stored therein and may include fasteners to hold components in place (such as hook and loop fasteners), straps, and the like. One or more compartments can include additional padding to protect the contents from damage (such as wine glasses). Optionally, the storage container can include attachments such as straps, rings (such as D-rings), or buckles to fasten the storage container to a vehicle, for example, a strap, ring, or buckle to hang the storage container on the back of a vehicle seat. In some aspects, inventive concepts include a storage container that includes two detachable sections. A first section can be configured to house the cantilever table in its storage (collapsed) format, while a second section can be configured to contain glasses, utensils, plates, and the like. The storage container can include pockets to house small accessories or components.

These and other features of inventive cantilever tables will now be described.

Referring to FIG. 1, a perspective top view of a cantilever table is shown in its expanded, use configuration. Cantilever table 10 includes a first portion 12 and a second portion 20. First portion 12 has a proximal end 18 that includes a handle 26. First portion 12 includes an upper surface 28 and lower surface 36, which together define an interior space (not shown). In some aspects, first portion 12 has a width 14 and length 16.

Second portion 20 includes upper surface 30, beveled periphery 32, and peripheral slots 34. Peripheral slots 34 are configured to retain the stems of glasses, such as wine glasses. Dimensions of individual peripheral slots 34 can be uniform throughout a particular table, or they can be varied within a particular table. Similarly, dimensions of peripheral slots 34 (e.g., length and width) can be selected to accommodate different types of glass stems, such as wine glasses or champagne glasses.

Second portion 20 is illustrated having a polygon shape that includes sides having varying lengths. The size and shape of second portion 20 can be selected depending upon the application of the cantilever table 10, for example, the particular vehicle with which it will be used, the desired use for the table (e.g., a table meant for a tailgate event, a meal, or as a workspace), and the number of people anticipated to use the table at any one time. Second portion 20 has a width 22 measured at its proximal end, and a length 24. In some aspects, the second portion 20 of the table 10 is larger than the first portion 12. In some embodiments, width 14 and length 16 of first portion 12 are equal to or less than width 22 and length 24 of second portion 20. In these aspects, first portion 12 can be stored beneath second portion 20 when the table is not in use. These aspects are described in more detail elsewhere herein.

Optionally, peripheral slots can also be included in the first portion 12 of the cantilever table (this option is not shown in the figures). The number and location of peripheral slots can be selected depending upon the number of people to use the table, the dimensions of the table, the vehicle to which the table is attached, and the like.

Upper surface 30 of the second portion 20 can optionally be provided with an anti-slip surface, such as a textured surface, a rubberized or silicone exterior "skin," or the like. The particular style, texture, and color of the anti-slip surface can be customized, for example, to provide a food safe surface, to match the paint color of the vehicle, or to include a logo of a favorite sport team or activity. Functionally, such anti-slip surface can provide improved grip for objects placed on the upper surface 30, such as plates, cups/glasses, utensils, bowls, and the like. Optionally, upper surface 28 of the first portion 12 can be provided with an anti-slip surface in similar fashion. When included, the anti-slip skin can be attached to the table using any suitable removable attachment, such as hook and loop fasteners, snaps, and the like. Such removable attachment may be beneficial to keep the exterior skin in place, for example, during use of the surface and/or in windy conditions.

Figure 2:
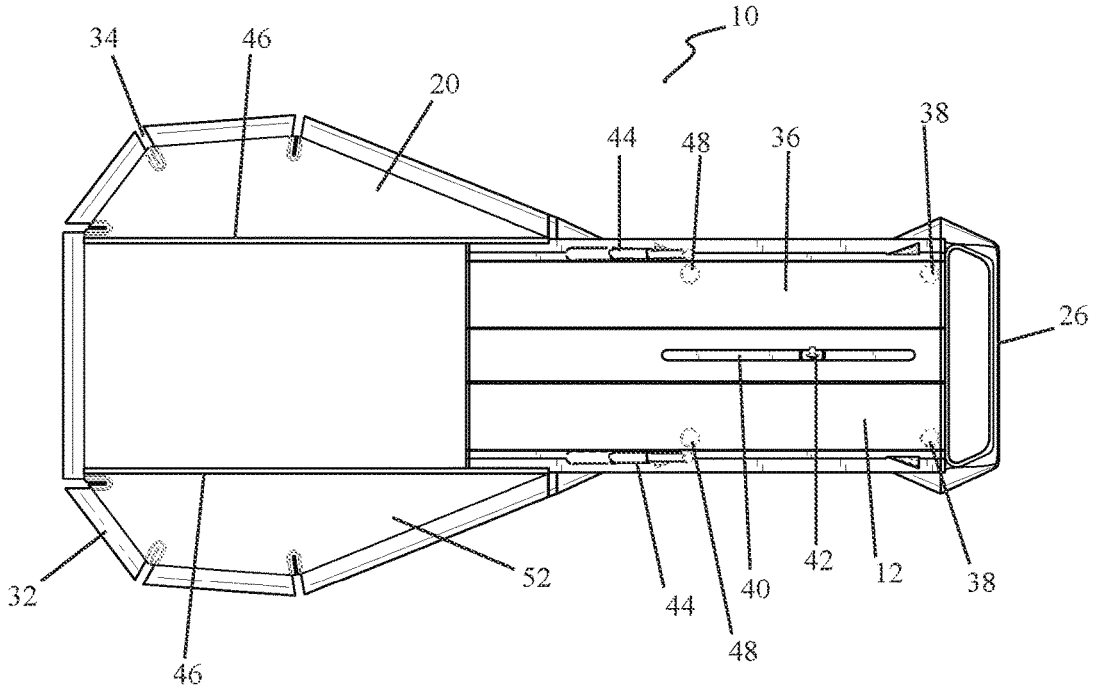
FIG. 2 is a perspective view showing the lower surface of the cantilever table of FIG. 1.
Figure 17:
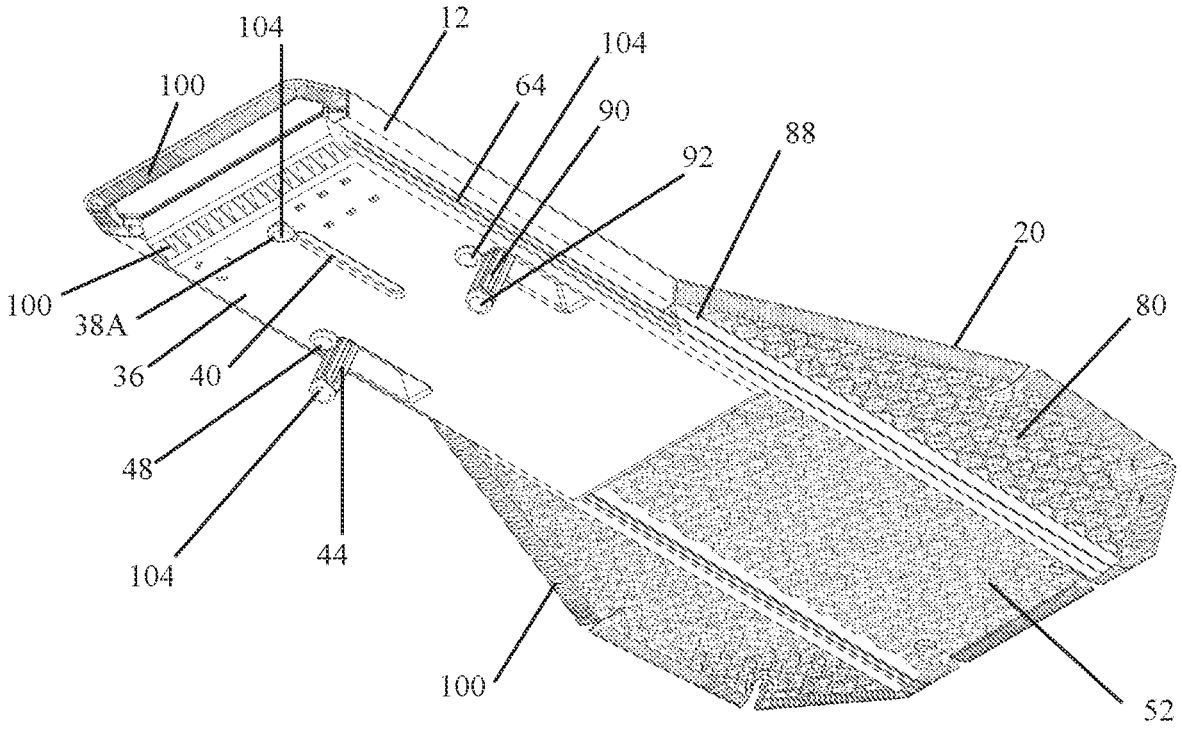
FIG. 17 is a perspective view showing the lower surface of the cantilever table of FIG. 16.

Turning to FIG. 2, table 10 is shown in perspective from the bottom surface. First portion 12 of the table 10 includes a lower surface 36. Lower surface 36 includes a first pair of threaded, independently adjustable supports 38 configured to extend downward from the lower surface 36. Lower surface 36 further includes a longitudinal channel 40 that houses a hook fastener 42. In some implementations, the first threaded, independently adjustable support 38 comprises a pair of supports, as illustrated in FIG. 2. However, inventive cantilever tables can include any desired number of first adjustable supports, such as one, two, three, or more. As the first adjustable support is located near the proximal end of the cantilever table, it typically contacts the interior of a vehicle when in use. The number of first adjustable supports to be included in a cantilever table can be selected based upon the versatility desired for an application, the type of vehicle with which the table will be used, dimensions of the table and/or trunk seal area, and the like. In some aspects, cantilever tables can include a single, first adjustable support (for example, as illustrated in FIG. 17, support 38A).

A second pair of independently adjustable supports 44 are located along the sides of the first portion 12. The second pair of supports 44 are configured to extend downwardly at an angle toward a bumper in the vehicle cargo area.

Also shown in FIG. 2 are channels 46 that are located at the lower surface 52 of the second portion 20. In some implementations, the first portion 12 is slidably engaged with the second portion 20 of the cantilever table 10 in a manner that allows the first portion to be stored beneath the lower surface of the second portion when the table is not in use. In accordance with these aspects, handle 26 can be used to urge the first portion 12 along channels 46 until the first portion 12 is located below the lower surface 52 of the second portion 20. Such a stacked configuration comprises a storage configuration for the table, as discussed below. Optionally, the first portion 12 is detachable from the second portion 20. In these aspects, the second portion 20 can be detached for serving food or beverages (for example, functioning as a serving tray or detachable table), for cleaning, and the like.

Figure 3:
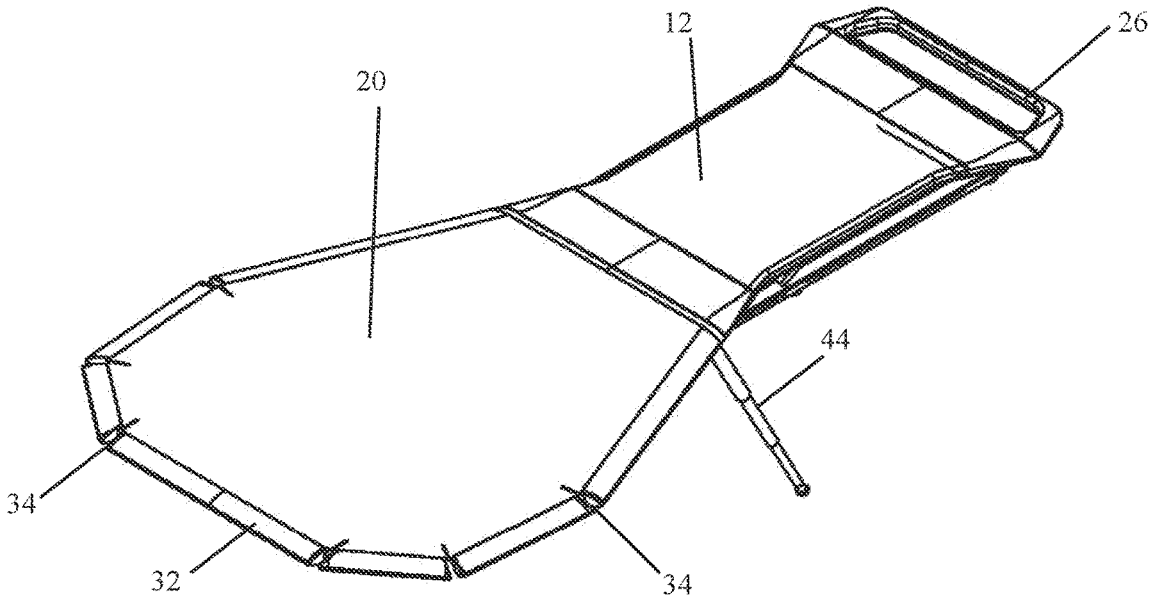
FIG. 3 is a perspective view of the cantilever table of FIG. 1 showing extended supports.

FIG. 3 illustrates a side perspective view of a cantilever table in accordance with some implementations, wherein the second pair of independently adjustable supports 44 have been extended from a first, storage position (shown in FIG. 1 and FIG. 2), to a use position. As shown, the second pair of independently adjustable supports 44 extend downward from the first portion 12 at an angle in a proximal direction (and thus toward a vehicle bumper area).

In some aspects, the second pair of adjustable supports 44 can provide lateral pressure to stabilize and support more weight on the outer areas of the cantilever table 10. The dimensions of the second pair of adjustable supports 44 can vary depending upon such factors as the dimensions and/or weight of the cantilever table 10, the intended vehicle for use, and the like. In some embodiments, the second pair of adjustable supports 44 can be about three to about six inches in length.

In some implementations, the second pair of independently adjustable supports 44 are provided as telescoping legs. That is, the supports (legs) can comprise segments that slide one within another, with a design that is similar to tubes of a jointed telescope, hiking poles or rifle supports. Coaxially telescoping legs allow the length of each leg to be adjusted individually. In this way, each adjustable support within the pair 44 can be independently lengthened or shorted, to adjust the plane of the table and to provide level stability and strength. Each telescoping leg is independently pivotally adjustable relative to the lower surface of the first portion. The pivotal adjustment of the legs permits the legs to be folded beneath the first portion, along the lower surface, for compact storage. During removal of the table and preparation for transportation or storage, a user simply applies pressure to pivot the legs to a collapsed or stored position beneath the first portion of the cantilever table.

Optionally, as illustrated in FIG. 17, components of the cantilever table 10 can be provided with a protective layer or surface 104 to minimize or avoid risk of damage to a vehicle when the table is used. In some aspects, any or all of the adjustable supports in accordance with inventive principles can include a protective layer or surface 104. In some embodiments, any or all of the adjustable supports can include a rubberized coating to protect the vehicle at contact points.

Figure 4:
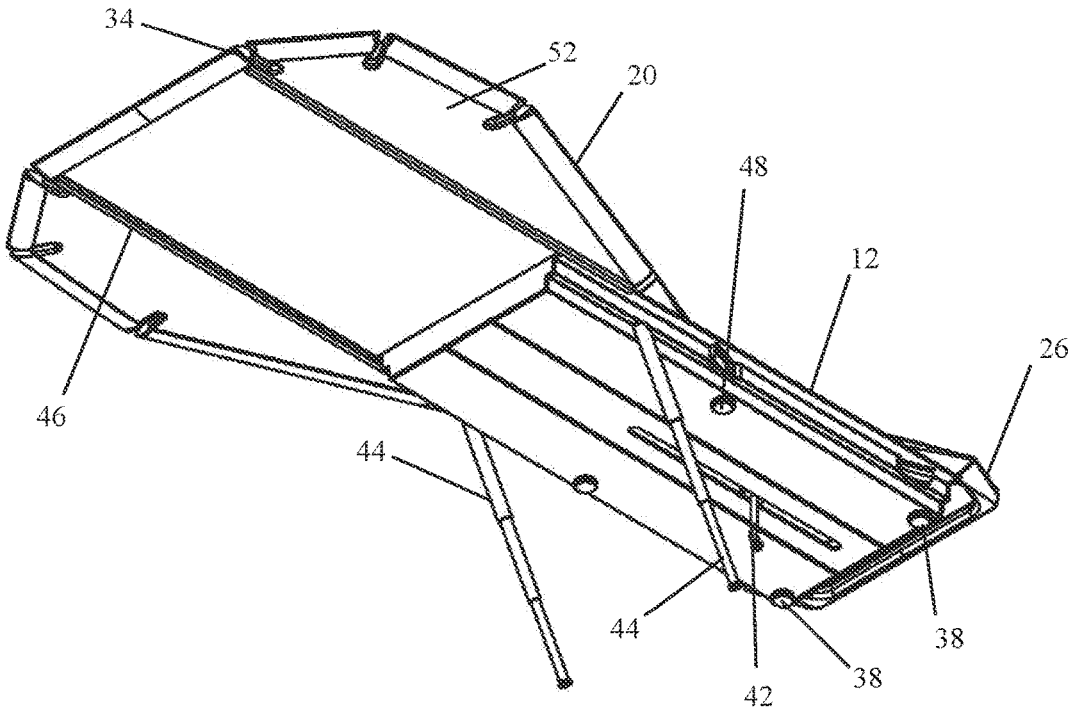
FIG. 4 is a perspective view showing the lower surface of the embodiment of FIG. 3.

As illustrated in FIGS. 2 and 4, the longitudinal channel 40 can extend for a distance that is longer than the length of the hook fastener 42. The particular length of longitudinal channel 40 can be varied depending upon the application of the cantilever table. In some aspects, providing a longitudinal channel 40 with a significant length along the lower surface 36 of the first portion 12 can increase the adaptability of the cantilever table 10 to a wide variety of vehicles. For example, hook fastener 42 can be slidably engaged within the channel 40, so that its relative longitudinal position along the cantilever table bottom can be changed to accommodate a particular vehicle closure latch and cargo area. In other words, the relative location of the hook fastener 42 can be changed with respect to the fixed first pair of threaded, adjustable supports 38 to take into account the vehicle closure latch, trunk seal dimensions, required force to maintain the cantilever table 10 in a stable position, and desired extension length from the interior of the vehicle.

In use, the hook fastener 42 attaches to and holds the cantilever table down using the vehicle's metal closure latch. The hook fastener can be fabricated from any suitable material that provides strength and durability. In some aspects, the hook fastener is fabricated of a metal. The hook fastener can optionally be magnetized, to assist in drawing the hook fastener toward the vehicle closure latch during installation on a vehicle. Optionally. the hook fastener 42 can include a knob opposite the hook, to assist a user during installation. The knob and hook fastener can be fabricated from the same, or a different, material. During installation, a user can turn the knob to tighten the hook fastener to the vehicle closure latch. The knob of the hook fastener can be accessible through an interior space defined by the upper surface 28 and lower surface 36 of the first portion 12. In some aspects, upper surface 28 can be defined by two or more panels that are lifted or removed to reveal the interior space (as described elsewhere herein). The knob of the hook fastener 42 can reside in the interior space.

Additional support and stability are provided to the cantilever table 10 by a first pair of threaded, independently adjustable supports 38. These threaded supports 38 are configured to engage the vehicle cargo area floor (e.g., trunk space). Thus, in some aspects, the first pair of threaded, adjustable supports 38 are provided at the proximal end of the first portion 12 of cantilever table 10. Each support of the pair is independently adjustable, in that it can be manually screwed upward or downward (relative to the plane of cantilever table 10), to lengthen or shorten the support. The amount extended can thus depend upon such factors as the height of the trunk seal area relative to the height of the vehicle closure latch and cargo storage area. The first pair of supports 38 thus provide additional support to the table and can assist in adjusting the relative horizontal pitch of the table 10. In accordance with inventive principles, the first pair of supports 38 will typically contact the vehicle within the cargo area (the interior of the vehicle). In some aspects, the first pair of supports 38 could contact the vehicle outside the cargo area (e.g., the bumper of the vehicle or the trunk seal area). The first pair of supports 38 can function to stabilize the cantilever table 10 and adjust the relative plane of the table so that it is horizontal no matter what the position of the vehicle (for example, when the vehicle is parked on a non-planar surface).

To install the cantilever table 10 within a vehicle cargo area, a user first employs handle 26 to pull the first portion 12 from a storage location under second portion 20. The first portion 12 is pulled until it aligns with the second portion 20. Thereafter, the user grasps the knob of the hook fastener, tilts the hook fastener 42 so that it protrudes from the longitudinal channel 40, and rotates the knob to thereby turn the hook fastener 42 while positioning the cantilever table 10. Once in position, the hook fastener 42 engages the vehicle closure latch, fixing the hook fastener in place. Further rotation of the knob thus tightens down the hook fastener 42, bringing the cantilever table 10 closer to the floor of the vehicle cargo area. Thereafter, the adjustable supports 38 and 44 are extended. The first pair of threaded adjustable supports 38 are extended by rotating each support to a desired height. The second pair of adjustable supports 44 are pivoted to a use position and extended as necessary to make appropriate contact with the bumper area of the vehicle. The adjustable supports 44 are locked into place to provide stability.

Optionally, inventive cantilever table 10 includes a third pair of supports 48 comprising threaded supports that can be independently extended downward by rotating each support of the pair. In some embodiments, the third pair of supports 48 contact a vehicle at a location that is between the hook fastener and the second pair of independently adjustable supports 44. Optionally, if the hook fastener 42 is moved to a distal location within the longitudinal channel 40, the third pair of supports 48 can be positioned relatively close to the hook fastener 42. In some aspects, the third pair of supports 48 contact the vehicle at a location that is distal to the closure latch, for example, on the bumper. The third pair of supports 48 provide additional stability to the cantilever table 10 when in use, and also provide additional fine tuning of the horizontal position of the table. The third pair of adjustable supports can be threaded and can be independently extended downward by rotating each support. When included, the third pair of supports 48 can function to stabilize the cantilever table 10 and adjust the relative plane of the table so that it is horizontal no matter what the position of the vehicle (for example, when the vehicle is parked on a non-planar surface).

In some implementations, inventive design concepts allow the cantilever table to be leveled about two pivot axes, to accommodate any angle at which vehicle is parked. Inventive cantilever tables include threaded and telescoping support members that can be independently adjusted to provide a level table surface regardless of the pitch of the vehicle in a forward to rear direction, or side to side direction, such as if the vehicle is parked on a slope. It will be readily appreciated, upon review of this disclosure, that any of the adjustable supports 38, 44 and/or 48 can be substituted with support members having other adjustment features. For example, the threaded adjustment and/or telescoping legs can be substituted with other suitable support mechanisms that provide an adjustment feature, such as nested supports, U-shaped supports, and the like. Similarly, supports described herein as "threaded" or "telescoping" are interchangeable, for example, adjustable supports 38, 44 and/or 48 can be threaded or telescoping as desired.

Figure 5:
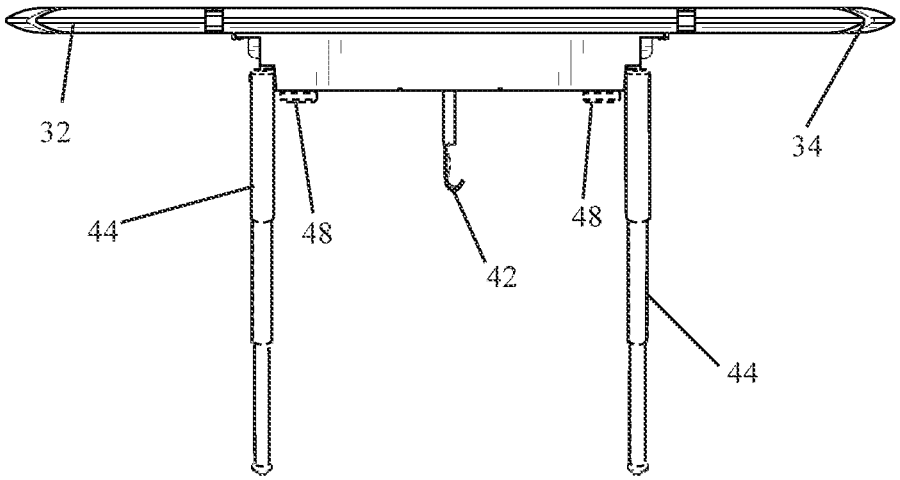
FIG. 5 is a perspective view from the distal end of the cantilever table shown in FIG. 3.
Figure 6:
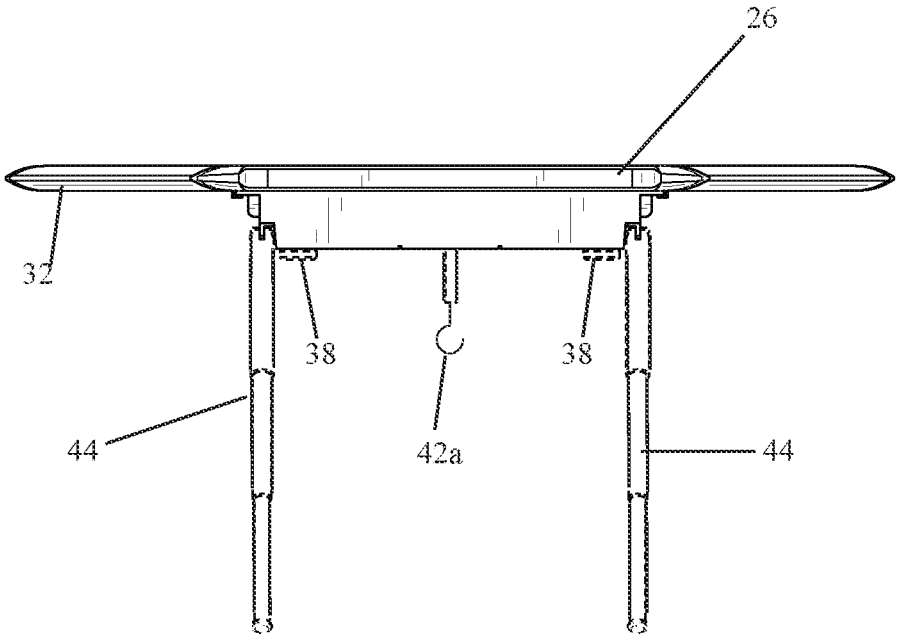
FIG. 6 is a perspective view from the proximal end of the cantilever table shown in FIG. 3.

FIG. 5 illustrates a perspective view of a cantilever table 10, from the distal end. The second pair of independently adjustable supports 44 are shown in their extended position, and hook fastener 42 is shown as a J hook extending from the longitudinal channel. Also shown are third pair of adjustable supports 48, beveled periphery 32 and peripheral slots 34. FIG. 6 illustrates a perspective view of the cantilever table 10 from the proximal end, wherein the hook fastener is shown as a cup hook 42*a* extending from the longitudinal channel. Also visible from this view are handle 26, beveled periphery 32, first pair of threaded, independently adjustable supports 38, and second pair of independently adjustable supports 44.

Figure 7:
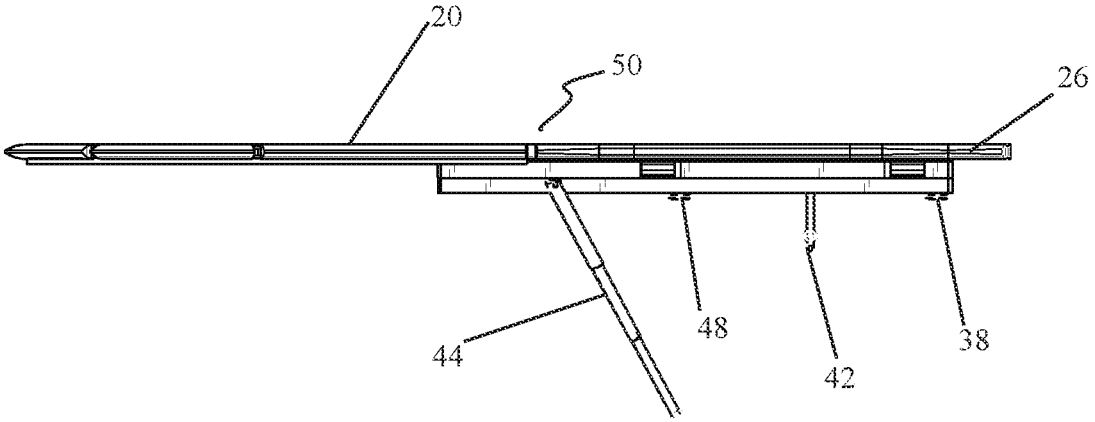
FIG. 7 is a perspective view from a side of the cantilever table of FIG. 3.

FIG. 7 illustrates a perspective side view of the cantilever table 10 shown in FIG. 3. As shown, the extended (use) form of the cantilever table 10 can provide a planar upper surface 50 when first portion 12 has been slidably extended from its storage position below the second portion 20. In this way, the upper surface 50 of the overall cantilever table 10 provides a uniform, planar, expanded surface that can be utilized as a table for socializing.

Figure 8:
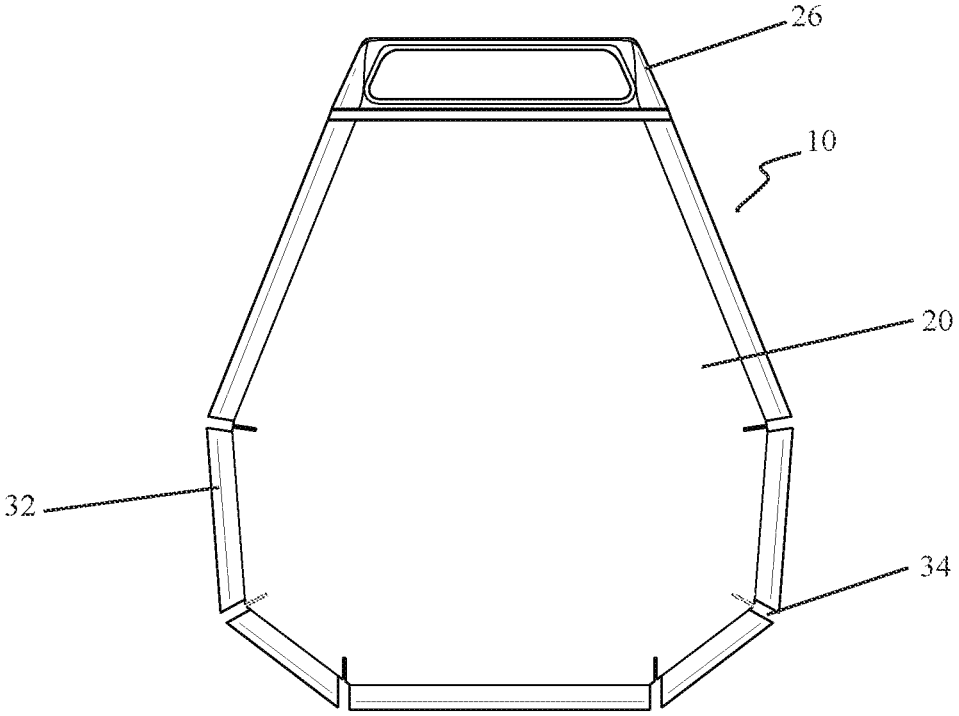
FIG. 8 is a perspective view showing the top surface of a cantilever table in a collapsed, storage configuration.

FIG. 8 shows a top perspective view of cantilever table 10 in a collapsed, storage form. In this form, handle 26 abuts the proximal end of second portion 20. The first portion 12 of the table is not visible from this view, as it is stored beneath the second portion 20. As will be appreciated upon review of this disclosure, handle 26 can serve a variety of functions; for example, handle 26 can be used to pull the first portion 12 from a storage position, to push the first portion 12 back into a storage position underneath the second portion 20, to carry the cantilever table 10 when not in use, and to adjust the position of the table 10 when installed on a vehicle.

Figure 9:
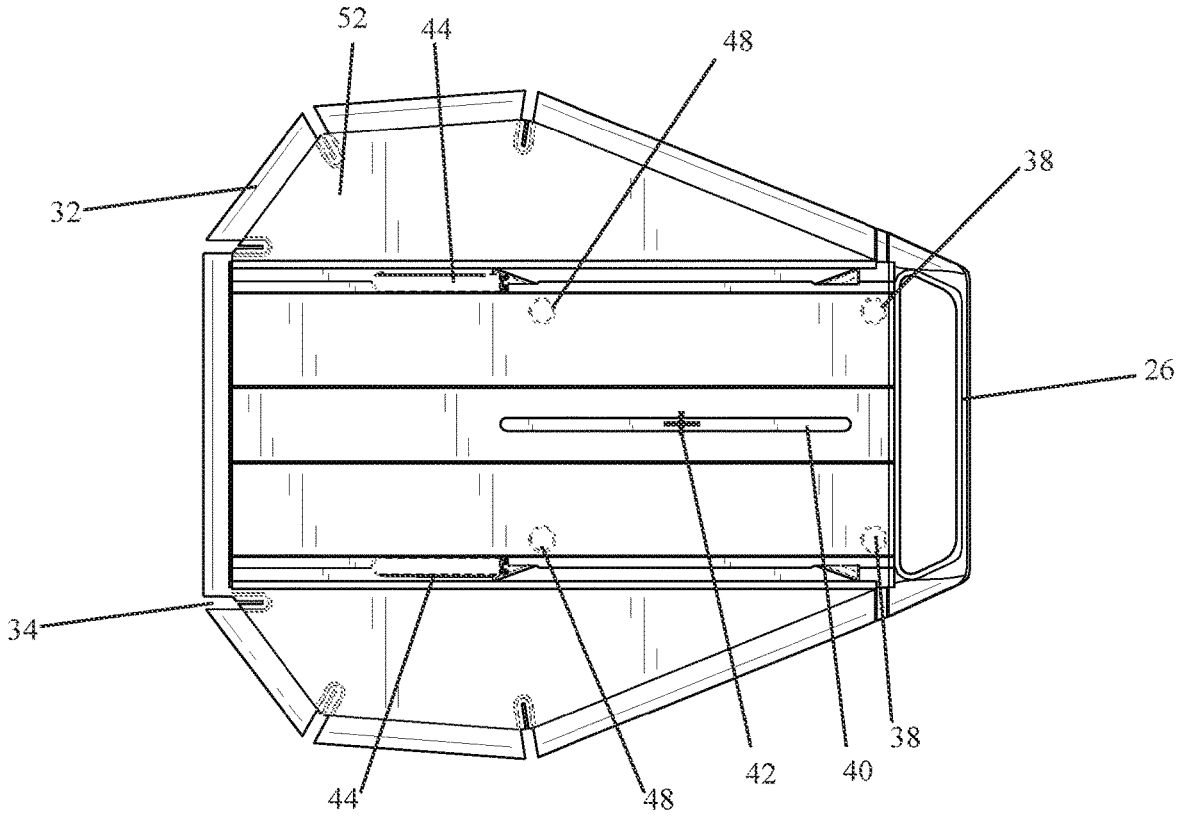
FIG. 9 is a perspective view showing the lower surface of the cantilever table of FIG. 8.
Figure 10:
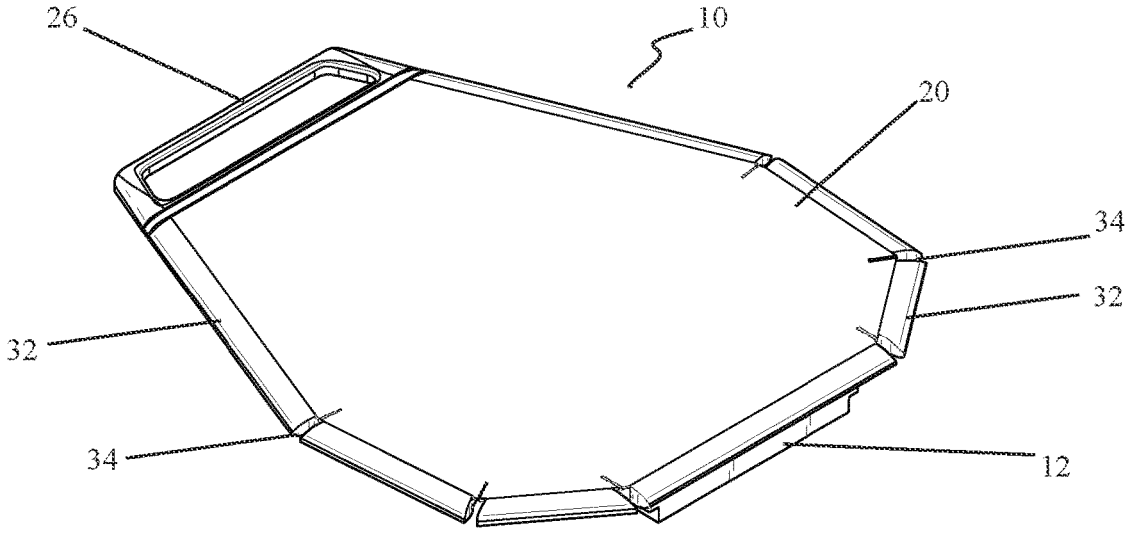
FIG. 10 is a perspective side view of the table of FIG. 8.
Figure 11:
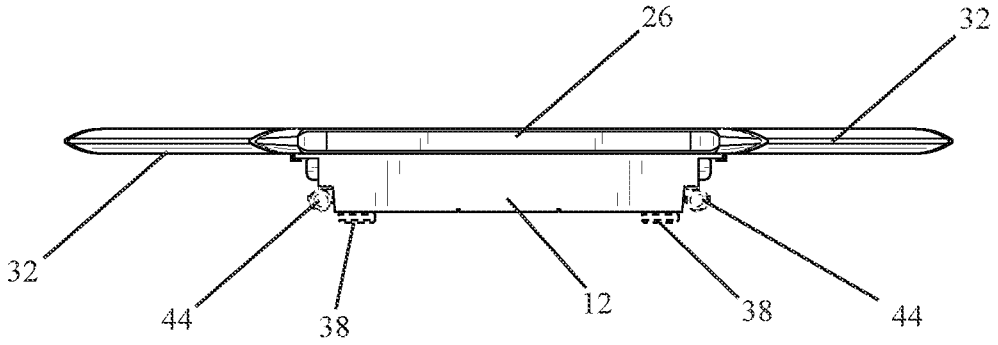
FIG. 11 is a perspective view from the proximal end of the cantilever table shown in FIG. 8.
Figure 12:
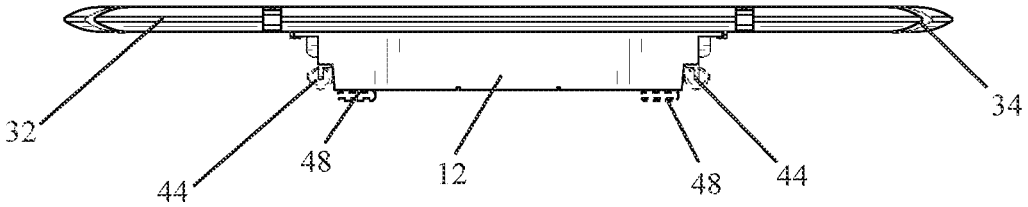
FIG. 12 is a perspective view from the distal end of the cantilever table shown in FIG. 8.
Figure 13:
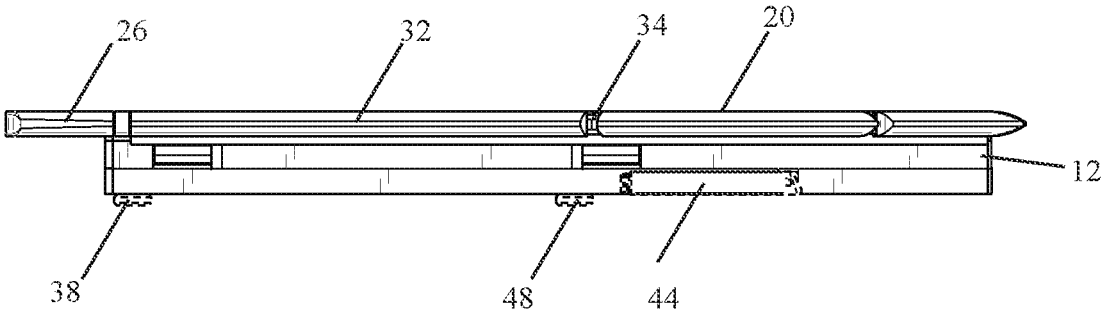
FIG. 13 is a perspective view from a side of the cantilever table shown in FIG. 8.
Figure 14:
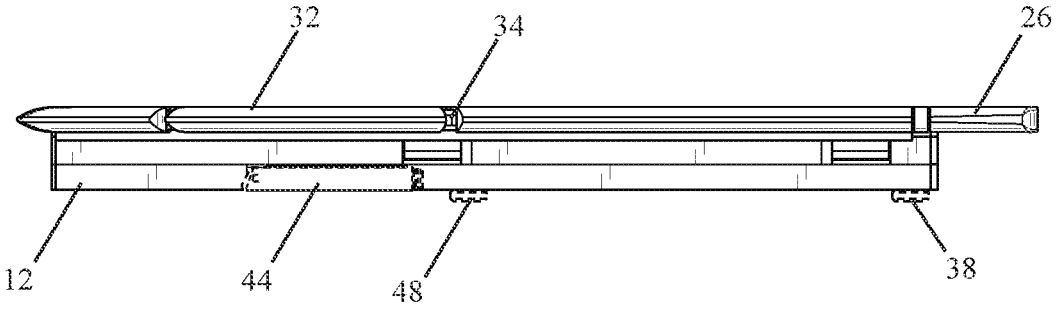
FIG. 14 is a perspective view from a side of the cantilever table shown in FIG. 8.

The collapsed, storage form shown in FIG. 8 thus provides a compact device that can easily be transported and stored, for example, in a cargo area of a vehicle. FIG. 9 shows a bottom perspective view of the device of FIG. 8, where the storage configuration of the second pair of adjustable supports 44 and the hook fastener 42 can be seen. Adjustable supports 44 have been urged into the storage location along the sides of the first portion 12, and hook fastener 42 has been pivoted back into a storage position within longitudinal channel 40. First portion 12 is positioned at the lower surface 52 of the second portion 20.

FIGS. 10-14 illustrate the compact nature of the cantilever table 10 when provided in its storage form. As illustrated, the first portion 12 is positioned beneath the second portion 20 in the storage configuration. The second pair of adjustable supports 44 have been rotated to a location along the side of first portion 12, and the hook fastener 42 has been moved to a position within the longitudinal channel 40, to provide a low-profile table having no protruding components.

Figure 15:
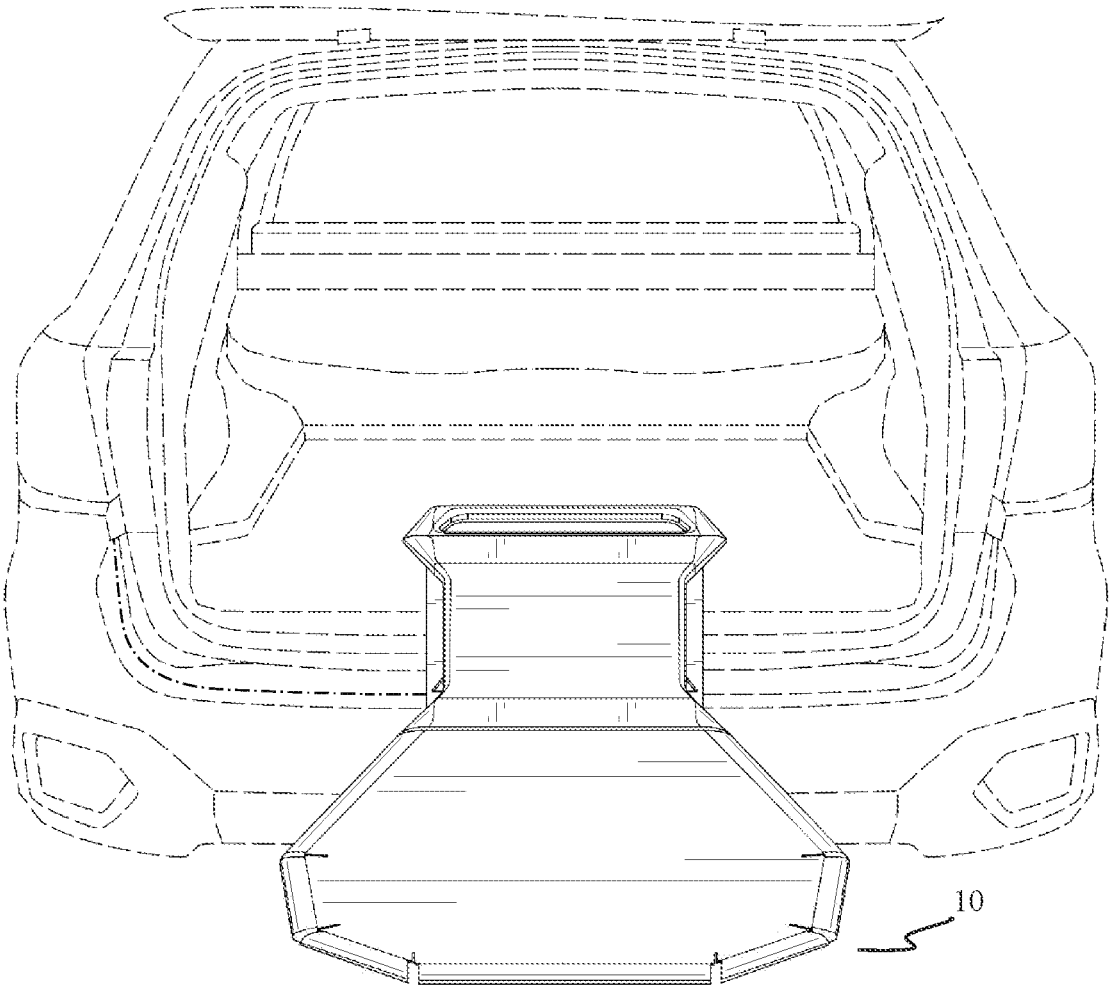
FIG. 15 is a perspective view of a cantilever table used in conjunction with a cargo area of a vehicle in accordance with inventive concepts.

FIG. 15 shows a perspective view of a cantilever table 10 attached to a vehicle at a cargo area. As illustrated, the proximal end of cantilever table 10 contacts the vehicle at a cargo area, and the table extends distally from the vehicle without contacting the ground.

Referring to FIG. 16, a perspective top view of an embodiment of a modular cantilever table is shown in its expanded, use configuration. Cantilever table 10A includes a first portion 12 and a second portion 20. First portion 12 has a proximal end 18 that includes a handle 26. First portion 12 includes an upper surface 28 and lower surface 36, which together define an interior space (not shown). As illustrated, section 60 and section 62 fit together to form upper surface 28.

Second portion 20 includes upper surface 30, beveled periphery 32, and peripheral slots 34. Peripheral slots 34 are configured to retain the stems of glasses, such as wine glasses. Dimensions of individual peripheral slots 34 can be uniform throughout a particular table, or they can be varied within a particular table. Similarly, dimensions of peripheral slots 34 (e.g., length and width) can be selected to accommodate different types of glass stems, such as wine glasses or champagne glasses. Peripheral slots 34 can be located at a variety of convenient locations around beveled periphery 32; one implementation is shown here.

As shown in FIG. 16, second portion 20 comprises center segment 76 and wings 78. In some implementations, wings 78 can be installed onto center section 76 to provide the full cantilever table 10A illustrated in FIG. 16. Optionally, one wing 78 can be used, or the cantilever table 10A can include only center segment 76. The modular construction of second portion 20 provides a cantilever table that can be configured to meet the particular needs of a user in different situations, for example, depending upon the use of the table (a meal versus a support surface for entertainment or work), the number of people using the cantilever table, and the like.

Turning to FIG. 17, cantilever table 10A is shown in perspective from the bottom surface. First portion 12 of the table 10A includes a lower surface 36. Lower surface 36 includes a first threaded adjustable support 38A configured to extend downward from the lower surface 36. Lower surface 36 further includes a longitudinal channel 40 that houses a hook fastener (not shown).

A second pair of independently adjustable supports 44 are located within chambers 74 that are formed as recesses from the lower surface 36. The second pair of supports 44 are configured to extend downwardly at an angle toward a bumper in the vehicle cargo area. As illustrated in FIG. 17, the second pair of supports 44 comprise a sleeve 90 and threaded support member 92 that can be extended from the sleeve 90 to contact a vehicle bumper area.

In some implementations, the first portion 12 is slidably engaged with the second portion 20 of the cantilever table 10A in a manner that allows the first portion to be stored beneath the lower surface of the second portion when the table is not in use. In accordance with these aspects, the first portion 12 includes slide 64, while the second portion includes track 88. The slide 64 and track 88 cooperate to permit the sliding engagement of the two table portions. Handle 26 can be used to urge the first portion 12 along tracks 88 until the first portion 12 is located below the lower surface 52 of the second portion 20. Such a stacked configuration comprises a storage configuration for the table, as discussed below. Optionally, the first portion 12 is detachable from the second portion 20. In these aspects, the second portion 20 can be detached for serving food or beverages (for example, functioning as a serving tray or detachable table), for cleaning, and the like.

FIG. 17 illustrates the track 88 having a T-track for engaging a slide 64 of the first portion 12. It will be readily appreciated that other sliding engagements, in addition to a T-track, can be utilized to slidably engage the first portion 12 and second portion 20.

As shown in FIG. 17, the second portion 20 can comprise a honeycomb framework 80, which can provide a lightweight, yet strong skeleton for the cantilever table. The honeycomb framework 80 can be visible from the exterior of cantilever table 10A, for example, the framework can be partially visible, completely visible, or entirely covered by an exterior shell so that it is not visible from the exterior of the table. Optionally, a release button can be included that would permit a user to disconnect the first portion 12 from the second portion 20 (feature not shown in the figure). Another optional feature of cantilever table 10A shown in FIG. 17 is ribbing 100 that can be included in peripheral areas of the cantilever table, such as the handle 26, the proximal edge of the first portion 12 near the handle 26, and/or the beveled periphery 32 of the second portion 20. Such ribbing can provide advantages, such as reduced table weight, improved strength and durability of the table, the ability of the table to support additional weight on the upper surface, and the like. While FIG. 17 illustrates ribbing 100 in each of these areas of the cantilever table, it will be readily appreciated that any one or more of these areas can be provided with ribbing, depending upon design preference.

In some implementations, inventive cantilever table 10A can be provided in a modular format. Such modular formats can provide advantages, such as flexibility in use (allowing the user to add or subtract portions of the table at the point of use, depending upon use conditions), customizable features, and ease of storage.

Optionally, peripheral slots 34 can also be included in the first portion 12 of the cantilever table (this option is not shown in the figures). As discussed herein with reference to the cantilever table 10, the number and location of peripheral slots can be selected depending upon the number of people to use the table, the dimensions of the table, the vehicle to which the table is attached, and the like.

Figure 18:
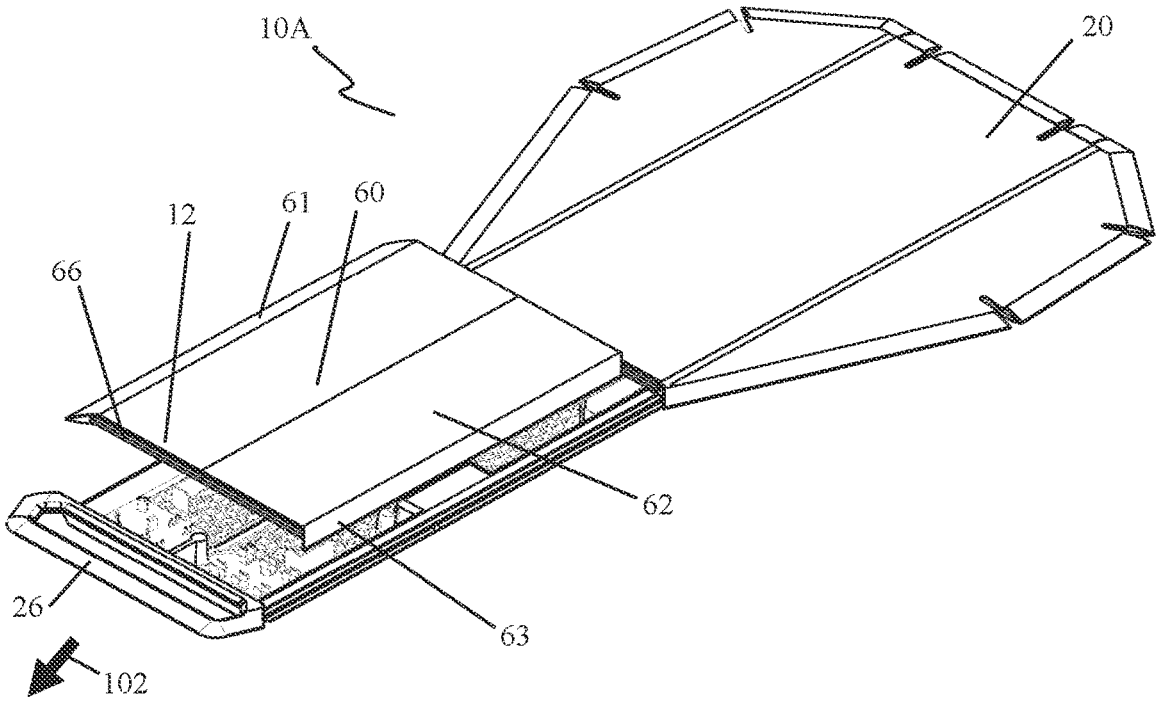
FIGS. 18-19 are perspective views showing removal of components to expose an interior space of the cantilever table of FIG. 16.
Figure 19:
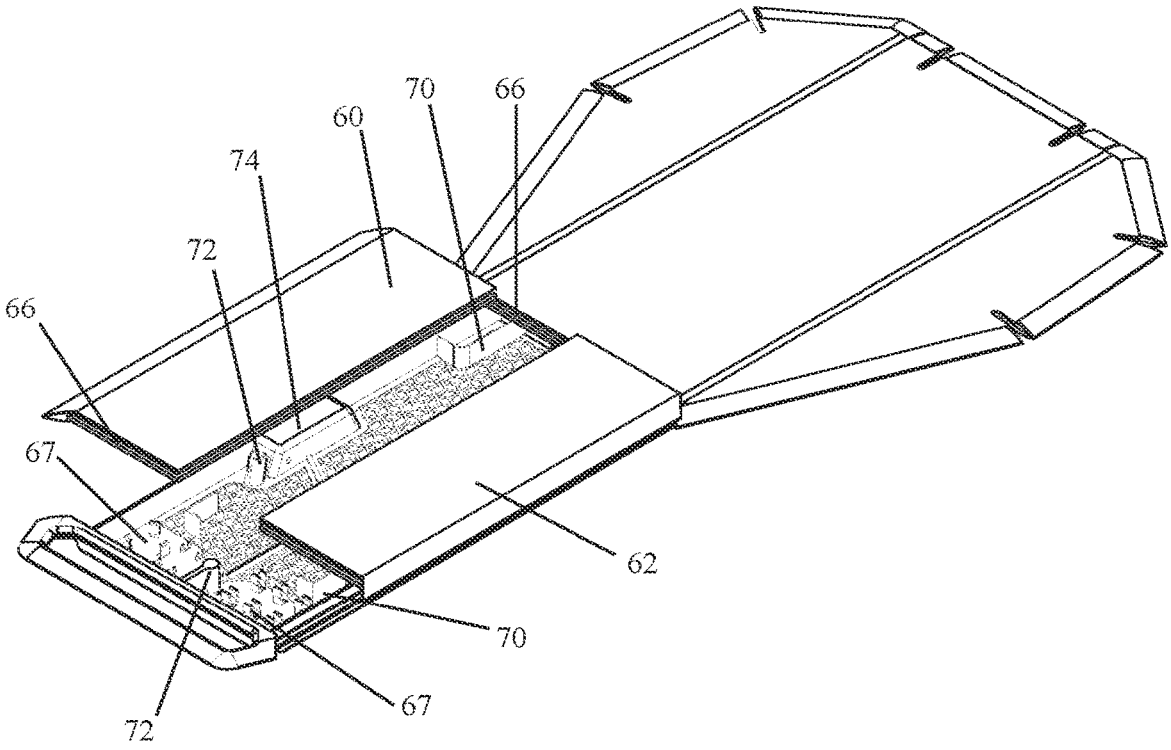
Figure 20:
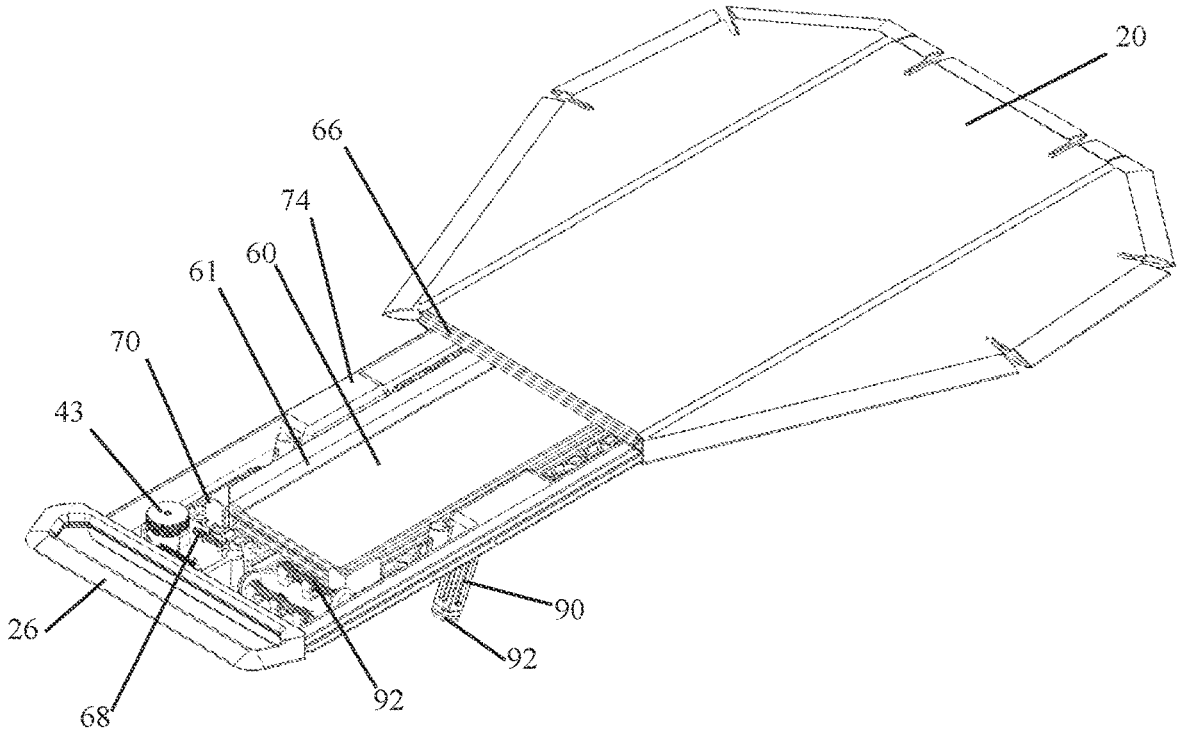
FIG. 20 is a perspective view of the cantilever table of FIG. 16, showing storage of removable components in an interior space.

FIGS. 18-20 illustrate features within the interior space within the first portion 12 of cantilever table 10A. To expose the interior space, a user can urge handle 26 away from the second portion 20, in the direction of arrow 102. For example, a user can grasp handle 26 in one hand, and the second portion 20 in the other hand, and pull the areas apart. This action separates the handle 26 from sections 60 and 62, and sections 60 and 62 from the second portion 20. Optionally, the cantilever table 10A can include a quick release button that releases the connection between the handle 26, first portion 12, and/or the second portion 20 (not shown).

In some implementations, section 60 and section 62 can fit together in a mating configuration, for example, via a tongue and groove joint. As illustrated in FIG. 18, sides of section 60 and section 62 can include grooves or tongues along three sides of the section, to permit fitting into the cantilever table 10A in a strong, flat manner. In one embodiment, tongue 66 is provided along the proximal edge of sections 60 and 62, so that this edge can seat into a corresponding groove in handle 26. In a similar manner, the proximal edge of second portion center section 76 can include a tongue 66 that seats into a corresponding groove in the distal edge of sections 60 and 62. Other mating configurations can be utilized in addition to, or as a substitute for, a tongue and groove joint. For example, interference fit connections, pins and the like can be used to provide a snap fit.

In some implementations, sections 60 and 62 can include side panels 61 and 63, respectively. Side panels 61 and 63 can be provided at a right angle relative to the upper surface of sections 60 and 62. In some implementations, side panels 61 and 63 can be provided at an angle relative to the upper surface of sections 60 and 62 so that when installed they provide a beveled periphery similar to that of section portion 20. In some aspects, side panels 61 and 63 can be hinged, so that they can collapse into a storage configuration (wherein side panel 61 is flat against section 60, and side panel 63 is flat against section 62), such that they can be stacked in the interior space of the first portion 12, as shown in FIG. 20. When the sections 60 and 62 are fitted together to form the first portion, side panels 61 and 62 can extend to provide a beveled periphery that aligns with the beveled periphery of the section portion 20 (see FIG. 26).

Turning to FIGS. 19-20, a configuration that allows for compact storage of removable components of cantilever table 10A is illustrated. In some implementations, the interior space of first portion 12 can include one or more storage areas that are configured to house removable components of the cantilever table when not in use. Such storage areas can include snap-in areas 66. In some implementations, the interior space can include metal plate 68 for additional support and durability in the snap-in areas 67. The interior space can include guides 70 for seating and storing sections 60 and 62 when not in use.

Also visible are slots 72, which are configured to receive adjustable supports when the cantilever table 10A is in use. Slots 72 include openings on the lower surface 36 of the first portion 12, these openings being sized to receive adjustable supports for supporting and stabilizing the cantilever table 10A, such as first adjustable support 38A and third pair of adjustable supports 48. In some aspects, slots 72 are threaded, such that they engage corresponding threads on an adjustable support inserted therein. In the embodiment illustrated in FIG. 19, slots 72 are closed at one end, to prevent the adjustable supports from passing through the entirety of slot 72 and into the interior space of first portion 12. In these aspects, the closed ends can minimize damage or destabilization of components of the first portion 12, such as sections 60 and 62. Also shown in FIG. 19 is chamber 74, which is configured to receive and store the second pair of independently adjustable supports 44.

As shown in FIG. 20, sections 62 and 60 are collapsed and stored in a stacking configuration within the area defined by guides 70 in the interior space of the first section 12. Side panel 61 is collapsed against section 60 to provide a flat, storage configuration. Threaded support members 92 and hook fasteners 42 are seated within snap-in areas 67. In some implementations, threaded support members of varying length can be stored within interior space of the first section 12. For example, shorter threaded support members can be beneficial when the cantilever table 10A is used in connection with a more compact vehicle (where distance from the lower surface 36 and the bumper area of the vehicle is shorter). In turn, longer threaded support members can be beneficial when the cantilever table 10A is used in connection with larger vehicles and SUVs (where distance from the lower surface 36 and the bumper area is longer). Such embodiments can provide a universal, customizable cantilever table that can be used with a variety of vehicles. In some implementations, snap-in areas 67 can house spare parts or customized parts of cantilever tables. Thus, in some aspects, the support members 38, 38A, 44 and 48 are removable and interchangeable.

Also stored within the embodiment illustrated in FIG. 20 is adjustment knob 43, which can be removably attached to hook fastener 42. As discussed elsewhere herein, adjustment knob 43 and hook fastener 42 can be fabricated from the same, or a different, material. A user can select the length of hook fastener 42 desired for the specific application (vehicle), pass the hook fastener 42 through the longitudinal channel 40 such that the portion that will engage the closure latch of the vehicle protrudes from the lower surface 36 of the cantilever table, and attach the adjustment knob 43 to the end of the hook fastener 42 that remains within the interior space of the first portion 12. In some implementations, hook fastener 42 and adjustment knob 43 can be attached through a threaded engagement, so that a user simply screws on the adjustment knob 43 by rotating it onto the threaded end of the hook fastener 42. Other attachment mechanisms can be used to connect the adjustment knob 43 to the hook fastener 42 (e.g., snap-on or other temporary engagements). During installation, a user can turn the adjustment knob 43 to tighten the hook fastener to the vehicle closure latch.

In accordance with inventive concepts, the hook fastener is freely movable along the longitudinal channel and rotatable within the longitudinal channel. Once knob 43 is engaged with the hook fastener 42, the knob can be used to rotate the hook fastener 360 degrees and/or urge the hook fastener along the longitudinal channel 40 until the hook fastener is in a position to engage the closure latch of the vehicle. This free movement within the longitudinal channel allows the hook fastener to be positioned to engage a closure latch in a vehicle, thereby anchoring the cantilever table.

Figure 21:
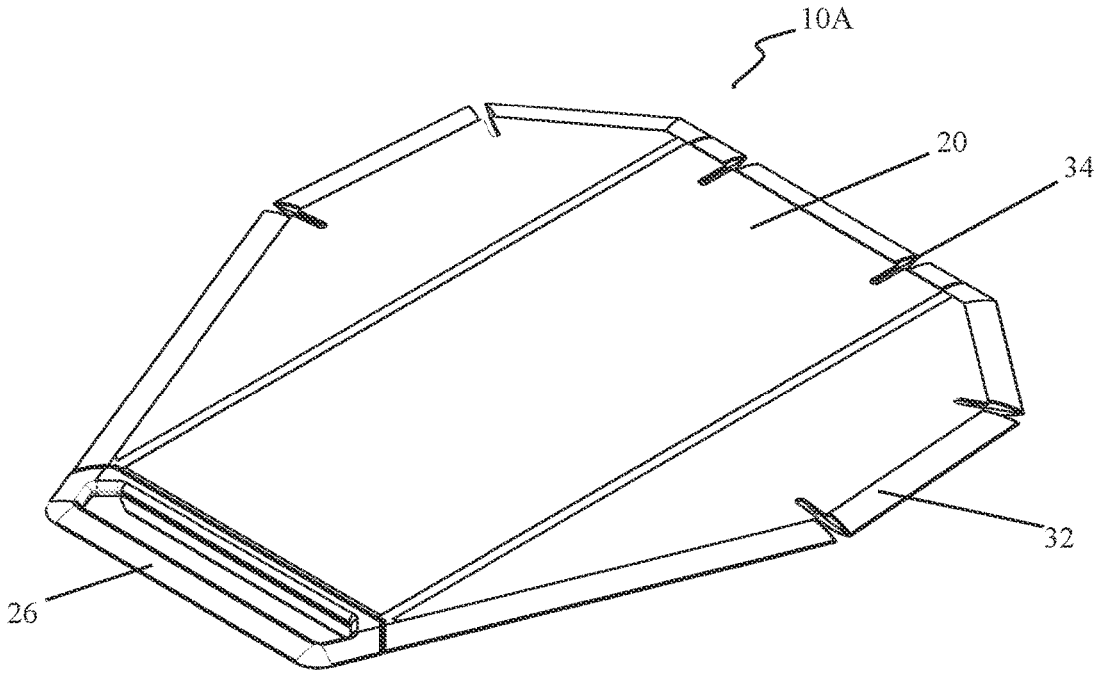
FIG. 21 is a perspective view showing the top surface of a cantilever table in a collapsed, storage configuration.

FIG. 21 illustrates a compact, storage configuration of cantilever table 10A. In some implementations, once removable components have been stored within the interior space of first portion 12, handle 26 can be urged toward the section portion 20, until the tongue 66 of the second portion 20 engages the groove of the first portion 12. The cantilever table 10A is now in a compact, stable configuration that is suitable for storage and/or transportation.

Figure 22:
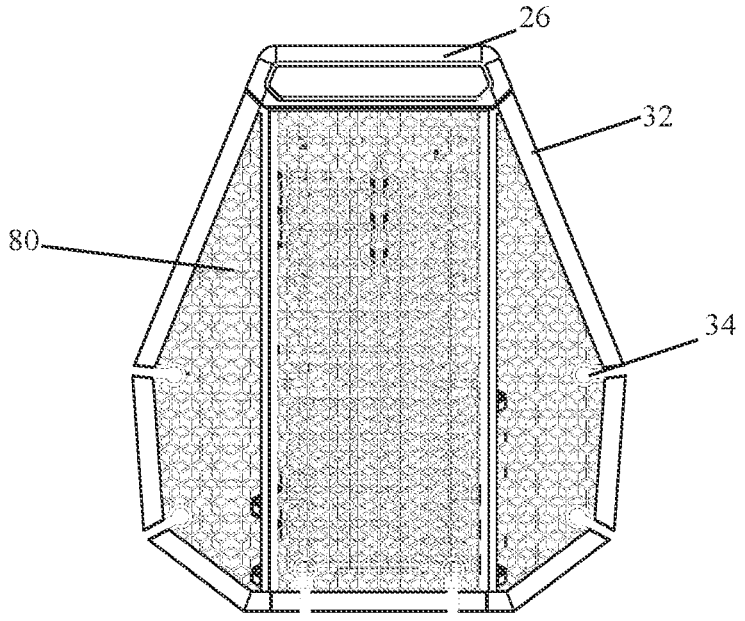
FIG. 22 is a perspective view showing a honeycomb framework of a cantilever table.
Figure 23:
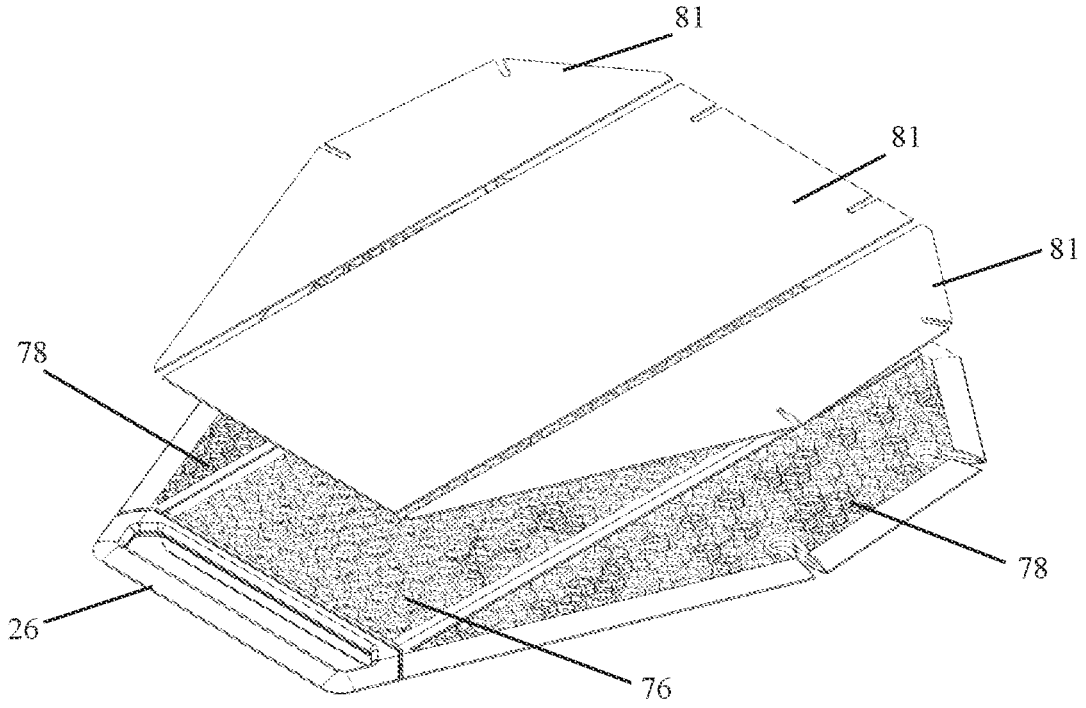
FIG. 23 is a perspective view of an exterior skin applied to the honeycomb framework of a cantilever table.

FIG. 22 provides a top view of the embodiment illustrated in FIG. 21, showing the honeycomb framework 80. Handle 26, beveled periphery 32 and peripheral slots 34 are illustrated. As shown, the removable components contained with the first section 12 interior space can be seen through the honeycomb framework 80, yet are entirely contained within the cantilever table. FIG. 23 illustrates a modular exterior skin 81 that can be applied to the upper surface 30 of the second portion 20. In this implementation, three separate sections of exterior skin 81 are provided, one for each wing 78, and one for the center segment 76. The particular style, texture, and color of the exterior skin can be customized, for example, to match the paint color of the vehicle, or to include a logo of a favorite sport team or activity. Functionally, such exterior skin can provide improved grip for objects placed on the upper surface 30, such as plates, cups/glasses, utensils, bowls, and the like. Optionally, upper surface 28 of the first portion 12 can be provided with an exterior skin in similar fashion.

Figure 24:
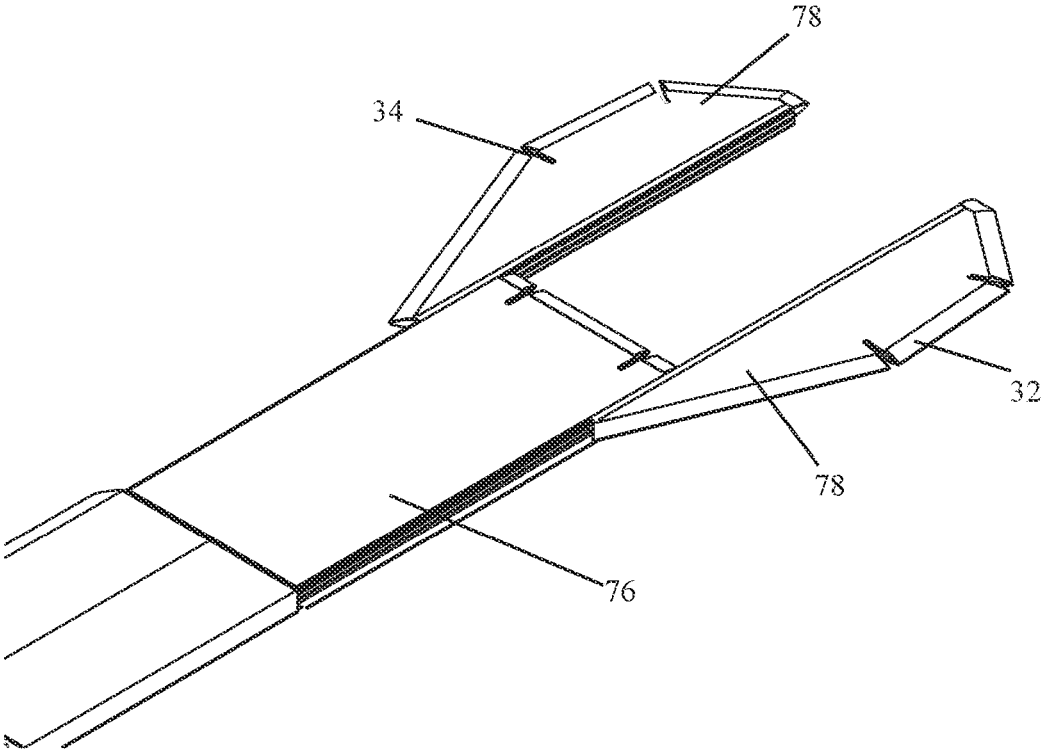
FIG. 24 is a perspective view of a cantilever table having removable wings.

FIG. 24 illustrates a modular embodiment for the second portion 20, where wings 78 can be removably attached to the center segment 76 via a sliding engagement. The sliding engagement can include a track (such as a T-track) for engaging a slide as described elsewhere herein. Similar sliding engagements can be substituted as well.

Figure 25:
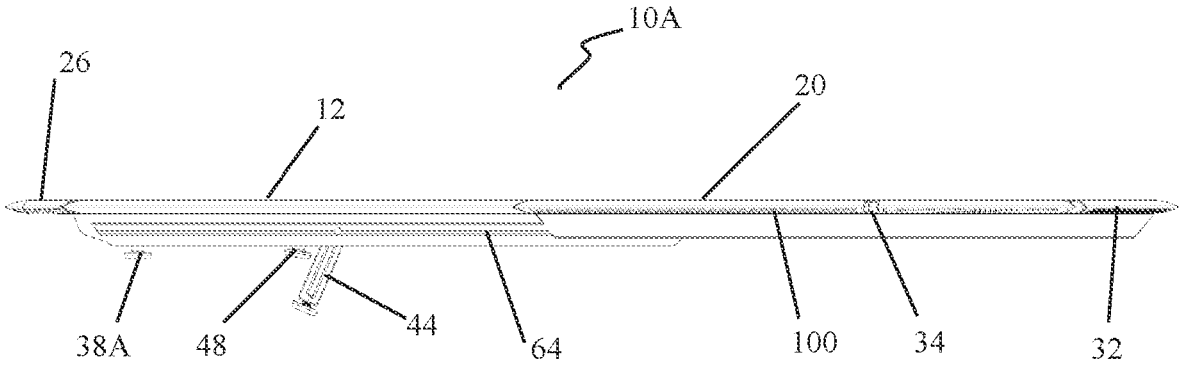
FIG. 25 is a perspective side view of the table of FIG. 16.

FIG. 25 illustrates a side view of a cantilever table 10A that includes first portion 12 and second portion 20. The first portion includes handle 26, first adjustable support 38A, third adjustable support 48, and second adjustable support 44. As shown, the third adjustable support can be tilted relative to the lower surface of the first portion 12, so that it contacts a vehicle at an angle. This can provide enhanced stability, support, and positional fine-tuning. Also shown along the side of the first portion 12 is the slide 64 for slidably engaging the track 88 to provide longitudinal, sliding engagement of the first portion 12 and second portion 20 of the table. The second portion of cantilever table 10A shows the beveled periphery 32, peripheral slots 34, and ribs 100.

Figure 26:
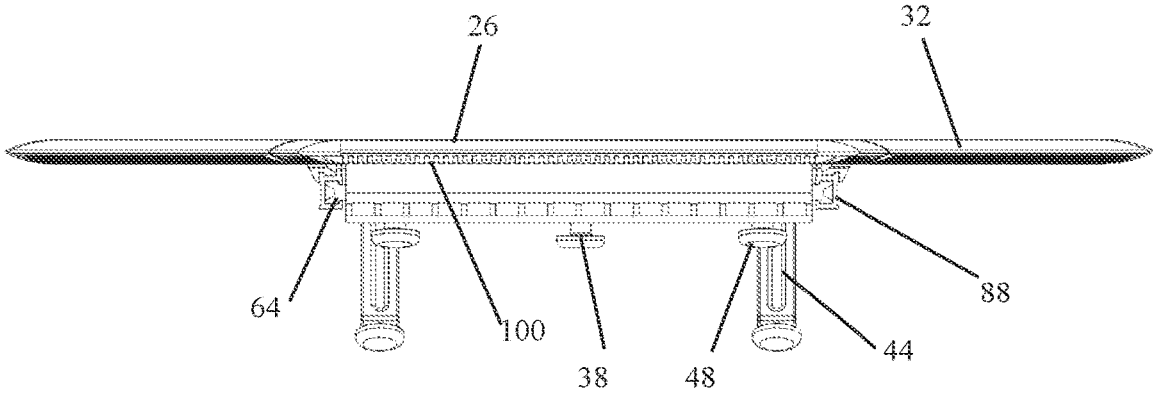
FIG. 26 is a perspective view from the proximal end of the cantilever table shown in FIG. 16.

FIG. 26 shows a proximal view of the cantilever table 10A. From the proximal end 18 of the table, the figure shows a handle 26 that contains ribbing 100 on its lower surface, first adjustable support 38, third adjustable support 48 (inclined at an angle in the proximal direction), and second adjustable supports 44. The track 88 of second portion 20 is shown surrounding the slide 64.

FIG. 27 illustrates a cantilever table 10B wherein wings 78 are not included. In these implementations, the cantilever table includes handle 26, first portion 12 and second portion 20. Second portion 20 includes two peripheral slots 34 and a beveled periphery 32. These embodiments can provide an extended, narrow cantilever table that does not include wings. FIG. 28 illustrates a storage configuration of the cantilever table of FIG. 27, wherein the first portion 12 is stored beneath the second portion 20.

Figure 29:
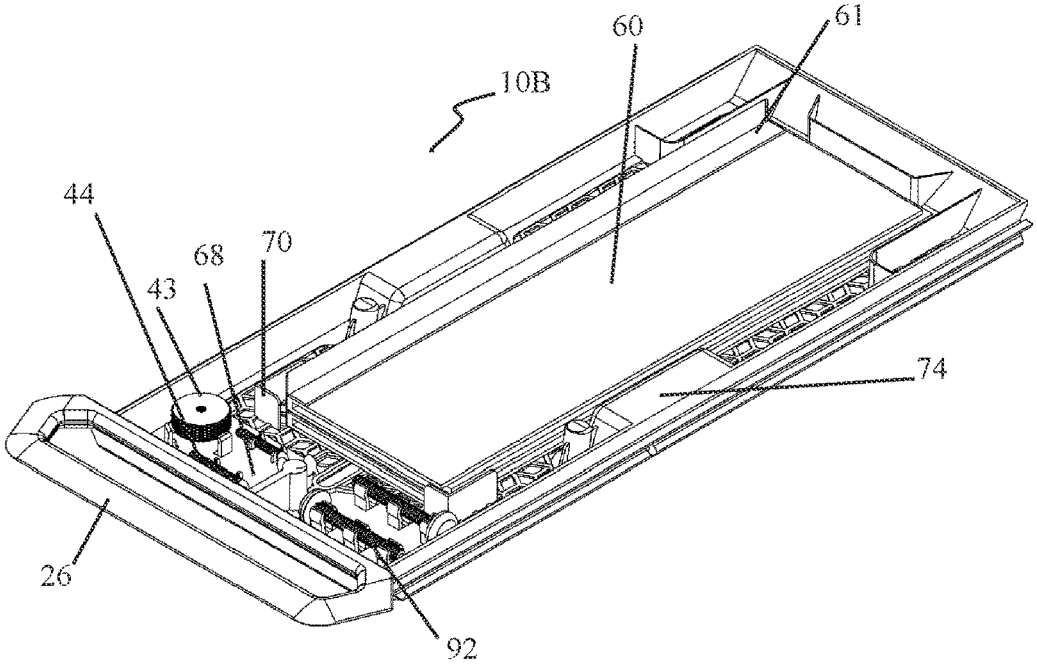
FIG. 29 is a perspective view showing the interior space of the cantilever table shown in FIG. 28.

FIG. 29 shows a configuration that allows for compact storage of removable components of the cantilever table 10B. In some implementations, the interior space of first portion 12 can include one or more storage areas that are configured to house removable components of the cantilever table when not in use. Such storage areas can include snap-in areas 67. In some implementations, the interior space can include metal plate 68 for additional support and durability in the snap-in areas 67. The interior space can include guides 70 for seating and storing sections 60 and 62 when not in use.

Also visible are slots 72, which are configured to receive adjustable supports when the cantilever table 10B is in use. Slots 72 include openings on the lower surface 36 of the first portion 12, these openings being sized to receive adjustable supports for supporting and stabilizing the cantilever table 10B. In some aspects, slots 72 are threaded, such that they engage corresponding threads on an adjustable support inserted therein. In the embodiment illustrated in FIG. 29, slots 72 are closed at one end, to prevent the adjustable supports from passing through the entirety of slot 72 and into the interior space of first portion 12. In these aspects, the closed ends can minimize damage or destabilization of components of the first portion 12, such as sections 60 and 62. Also shown in FIG. 29 is chamber 74, which is configured to receive and store the second pair of independently adjustable supports 44.

As shown in FIG. 29, sections 62 and 60 are collapsed and stored in a stacking configuration within the area defined by guides 70 in the interior space of the first section 12. Threaded support members 92 and hook fasteners 42 are seated within snap-in areas 67. In some implementations, threaded support members of varying length can be stored within interior space of the first section 12, as discussed elsewhere herein.

Also stored within the embodiment illustrated in FIG. 29 is knob 43, which can be removably attached to hook fastener 42, as discussed elsewhere herein.

Figure 30:
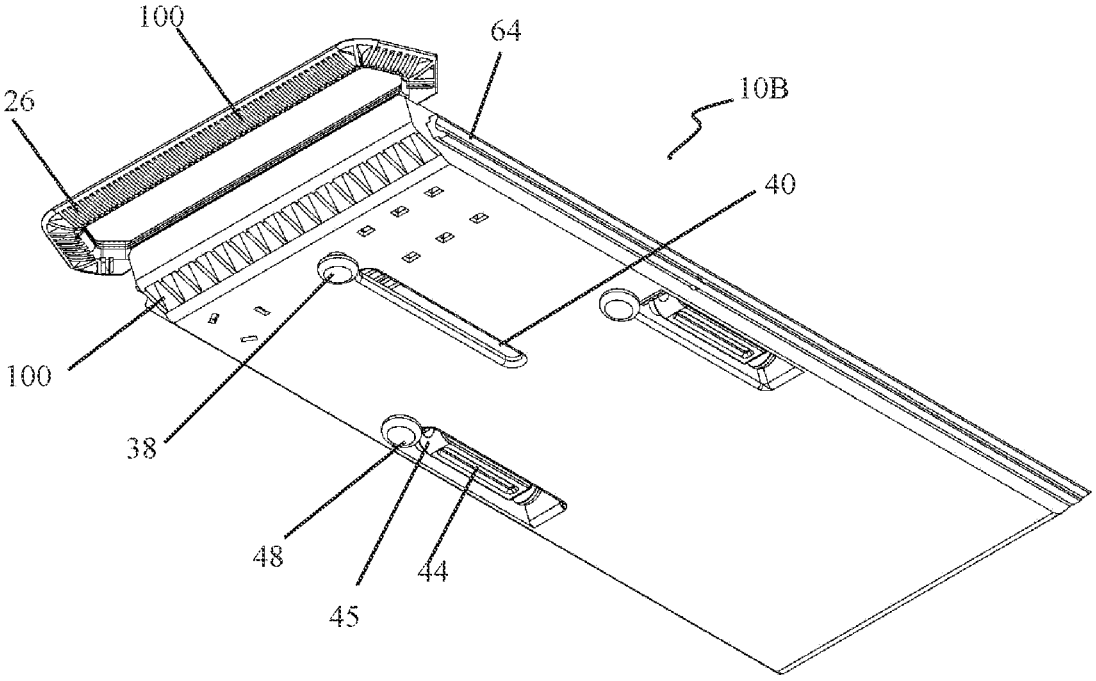
FIG. 30 is a perspective view showing the lower surface of the cantilever table of FIG. 28.

FIG. 30 is a bottom view of the cantilever table 10B of FIGS. 27-29. Illustrated are the handle 26, ribbing 100, first adjustable support 38, second adjustable supports 44, third adjustable supports 48, longitudinal channel 40 and slide 64. Second adjustable supports 44 are shown in a storage position, within chambers 74. Hinge 45 of the second adjustable support 44 is visible, which allows a user to pivot second adjustable supports 44 from a storage position (shown) to a use position, where the supports extend from the chamber 74 at an angle toward a vehicle. It will be appreciated that other pivot connections or joints may be utilized as a substitute for hinge 45. In some implementations, the pivotal adjustment of the second adjustable support 45 permits the supports to be stored within chambers 74 of the first portion, for compact storage. During removal of the table and preparation for transportation or storage, a user simply applies pressure to pivot the legs to a collapsed or stored position within the chambers 74.

In some aspects, inventive concepts provide an accessory kit for cantilever tables. Such accessory kits can include one or more of the following components: support members of varying lengths; hook fasteners of selected configurations to accommodate vehicle closure latches; cutting boards to use in conjunction with the first portion of the cantilever table; exterior skins for the first portion, center segment of the second portion, and/or wings of the second portion; stemware that is sized to be inserted into the peripheral slots; tableware that is sized or configured for use with the cantilever table; a storage or carrying case for the cantilever table when not in use; tools that could be useful for installation and/or adjustment of the cantilever table; and the like.

In some implementations, inventive concepts include a storage container, such as a bag or flexible receptacle. The storage container can include a main compartment for housing the main body of the cantilever table, and smaller compartments for accessories or removable parts. Such compartments may be sized to provide a snug fitting around the component(s) to be stored therein and may include fasteners to hold components in place (such as hook and loop fasteners), straps, and the like. One or more compartments can include additional padding to protect the contents from damage (such as wine glasses). Optionally, the storage container can include fasteners such as straps, rings (such as D-rings), or buckles to removably attach the storage container to a vehicle, for example, a strap, ring, or buckle to hang the storage container on the back of a vehicle seat, or to attach the storage container to a wall or floor area of the vehicle. In some aspects, inventive concepts include a storage container that includes two detachable sections. A first section can be configured to house the cantilever table in its storage (collapsed) format, while a second section can be configured to contain glasses, utensils, plates, and the like. The storage container can include pockets to house small accessories or components.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained.

In the specification and in the claims, the terms "including" and "comprising" are open-ended terms and should be interpreted to mean "including, but not limited to . . . ." These terms are broader than, and therefore encompass, the more restrictive terms "consisting essentially of" and "consisting of."

As used herein and in the appended claims, the singular forms "a," "an," and "the" include plural reference unless the context clearly dictates otherwise. As such, the terms "a" (or "an"), "one or more" and "at least one" can be used interchangeably herein.

The invention claimed is:

1. A cantilever table for mounting to a vehicle cargo area, the table comprising (a) a first portion having an upper surface, a lower surface, and a proximal end, the
first portion comprising
a handle at the proximal end,
a hook fastener configured to engage a closure latch in the vehicle cargo area,
a first adjustable support configured to extend vertically downward from the
lower surface, and
a second adjustable support comprising a pair of independently adjustable
supports configured to extend downwardly at an angle toward a bumper in the
vehicle cargo area; and (b) a second portion having an upper surface and a lower surface, wherein the first portion is slidably engaged with the second portion in a manner that allows the first portion to be stored beneath the lower surface of the second portion when the table is not in use, and wherein the cantilever table does not include a ground-contacting support component.

2. The cantilever table of claim 1 wherein the first portion contains a removable cutting board.

3. The cantilever table of claim 1 wherein the first adjustable support comprises a pair of independently adjustable supports configured to extend vertically downward from the lower surface.

4. The cantilever table of claim 1 wherein the lower surface of the first portion includes a longitudinal channel, and the hook fastener is located within the longitudinal channel.

5. The cantilever table of claim 4 wherein the hook fastener is movable from a storage position within the cantilever table to a use position that extends outside the longitudinal channel.

6. The cantilever table of claim 4 wherein the hook fastener is freely movable along the longitudinal channel and rotatable within the longitudinal channel.

7. The cantilever table of claim 1 wherein the upper surface and the lower surface of the first portion define an interior area, and wherein the hook fastener is accessible through the interior area.

8. The cantilever table of claim 7 wherein the interior area is configured to store removable components of the cantilever table.

9. The cantilever table of claim 1 wherein the hook fastener is magnetized.

10. The cantilever table of claim 1 wherein the hook fastener comprises an adjustment knob.

11. The cantilever table of claim 1 wherein the hook fastener is a J-hook or a cup hook.

12. The cantilever table of claim 1 wherein the hook fastener is configured to engage a trunk latch in the vehicle cargo area.

13. The cantilever table of claim 1 wherein the first adjustable support is positioned at the proximal end of the first portion.

14. The cantilever table of claim 1 wherein the second pair of adjustable supports comprises telescoping legs or a sleeve containing a threaded support member.

15. The cantilever table of claim 1 further comprising a third adjustable support comprising a pair of independently adjustable supports configured to extend vertically downward from the lower surface.

16. The cantilever table of claim 15 wherein the third adjustable support comprises a protective surface where the supports contact the vehicle.

17. The cantilever table of claim 1 wherein the first adjustable support, the second adjustable support, or both the first and second adjustable supports comprises a protective surface where the supports contact the vehicle.

18. The cantilever table of claim 1 wherein the first portion comprises internal reinforcement elements.

19. The cantilever table of claim 1 wherein the upper surface of the second portion comprises a non-slip material.

20. The cantilever table of claim 1 wherein the upper surface of the second portion comprises one or more recesses sized to hold food or drink vessels.

21. The cantilever table of claim 1 wherein the second portion includes peripheral slots configured to receive beverage glasses having a stem.

22. The cantilever table of claim 1 wherein the second portion includes a beveled periphery.

23. The cantilever table of claim 1 wherein the first portion is detachable from the second portion.

24. An assembly comprising the cantilever table of claim 1 and a storage container configured to house the cantilever table when not in use.

25. The assembly of claim 24 wherein the storage container comprises fasteners to removably attach the storage container to a vehicle.

* * * * *